US011504764B2

(12) United States Patent
Yabunaka et al.

(10) Patent No.: US 11,504,764 B2
(45) Date of Patent: Nov. 22, 2022

(54) FASTENING TOOL

(71) Applicant: MAKITA CORPORATION, Anjo (JP)

(72) Inventors: Toshihito Yabunaka, Anjo (JP); Hiroki Ikuta, Anjo (JP); Koichi Yakabe, Anjo (JP); Takao Kuroyanagi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 42 days.

(21) Appl. No.: 17/342,032

(22) Filed: Jun. 8, 2021

(65) Prior Publication Data

US 2021/0394254 A1 Dec. 23, 2021

(30) Foreign Application Priority Data

Jun. 23, 2020 (JP) ..... JP2020-107805

(51) Int. Cl.

| | |
|---|---|
| ***B21J 15/26*** | (2006.01) |
| ***B21J 15/02*** | (2006.01) |
| ***B21J 15/32*** | (2006.01) |
| ***B21J 15/10*** | (2006.01) |

(52) U.S. Cl.

CPC ..... *B21J 15/26* (2013.01); *B21J 15/022* (2013.01); *B21J 15/105* (2013.01); *B21J 15/32* (2013.01)

(58) Field of Classification Search

CPC ..... B21J 15/26; B21J 15/022; B21J 15/105; B21J 15/32; B21J 15/30; B21J 15/285; B25B 21/00

See application file for complete search history.

(56) References Cited

U.S. PATENT DOCUMENTS

2021/0069773 A1* 3/2021 Yabunaka ..... B21J 15/285

FOREIGN PATENT DOCUMENTS

JP 2018-118294 A 8/2018
WO WO-2018123744 A1 * 7/2018 ..... B21J 15/022

* cited by examiner

*Primary Examiner* — Lee A Holly
(74) *Attorney, Agent, or Firm* — Oliff PLC

(57) ABSTRACT

A fastening tool includes a motor, a fastening mechanism, a tool body and a main handle. The motor includes a motor body and a motor shaft. The fastening mechanism is configured to fasten workpieces via a fastener by pulling a pin of the fastener rearward relative to a tubular part of the fastener along a driving axis defining a front-rear direction of the fastening tool. The tool body houses the motor and the fastening mechanism. The main handle extends in a direction crossing the driving axis and connected to the tool body such that the main handle and the tool body together form an annular part. A rotational axis of the motor shaft extends parallel to the driving axis. A portion of the main handle is located in a rear space extending behind the motor body.

16 Claims, 17 Drawing Sheets

FASTENING TOOL

CROSS-REFERENCE TO RELATED APPLICATIONS

The present application claims priority to Japanese patent application No. 2020-107805 filed on Jun. 23, 2020, the contents of which are hereby fully incorporated herein by reference.

TECHNICAL FIELD

The present disclosure relates to a fastening tool that is configured to fasten workpieces via a fastener.

BACKGROUND

An electric fastening tool is known that is configured to fasten workpieces via a fastener that includes a rod-like pin and a tubular part into which the pin is inserted. For example, Japanese Unexamined Patent Application Publication No. 2018-118294 discloses a fastening tool that includes a ball-screw mechanism that is driven by power of a motor. The ball-screw mechanism is configured to pull the pin in its axial direction relative to the tubular part to thereby deform the fastener and fasten workpieces via the deformed fastener.

SUMMARY

In the above-described fastening tool, the motor is located below the ball-screw mechanism in an outer housing and located at a lower side of the handle. A rotational axis of a motor shaft extends in a direction that intersects an axis along which the ball-screw mechanism moves the pin. Thus, an intermediate shaft is disposed between the motor and the ball-screw mechanism in order to transmit the power therebetween. Due to such a configuration, the above-described fastening tool leaves room for further improvement in operability and power transmission.

Accordingly, it is an object of the present disclosure to provide techniques that contribute to improved operability and efficient power transmission in a fastening tool that fastens workpieces via a fastener.

One aspect of the present disclosure provides a fastening tool that is configured to fasten workpieces via a fastener that includes a pin and a tubular part. The fastening tool includes a motor, a fastening mechanism, a tool body, and a main handle.

The motor includes a motor body and a motor shaft. The motor body includes a stator and a rotor. The motor shaft extends from the rotor and is configured to rotate integrally with the rotor. The fastening mechanism is configured to fasten the workpieces via the fastener by pulling the pin rearward relative to the tubular part along a driving axis, using power of the motor. The driving axis defines a front-rear direction of the fastening tool. The tool body houses the motor and the driving mechanism. The main handle is elongate and extends in a direction crossing the driving axis. The main handle is connected to the tool body such that the main handle and the tool body together form an annular (loop-shaped, ring shaped) part. A rotational axis of the motor shaft extends parallel to the driving axis. A portion of the main handle is located in a rear space extending behind the motor body. In other words, when the motor body is seen from the rear, a portion of the main handle overlaps with a region that is occupied by the motor body (a region that is enclosed by an outer circumference of the motor body). Here, "the rear space extending behind the motor body" may be also called a space that is occupied by projection of the motor body when the motor body is projected rearward.

In the fastening tool according to this aspect, the motor and the fastening mechanism are disposed such that the rotational axis of the motor shaft and the driving axis of the fastening mechanism are parallel to each other. Accordingly, compared to a configuration in which the rotational axis of the motor shaft and the driving axis extend in directions crossing each other, the motor and the fastening mechanism can be disposed closer to each other, so that more efficient power transmission can be achieved. Further, since a portion of the main handle is disposed in the rear space of the motor body, a user can grip the main handle at a position relatively close to the driving axis, so that operability of the fastening tool can be improved.

DETAILED DESCRIPTION OF THE EMBODIMENTS

Figure 1:
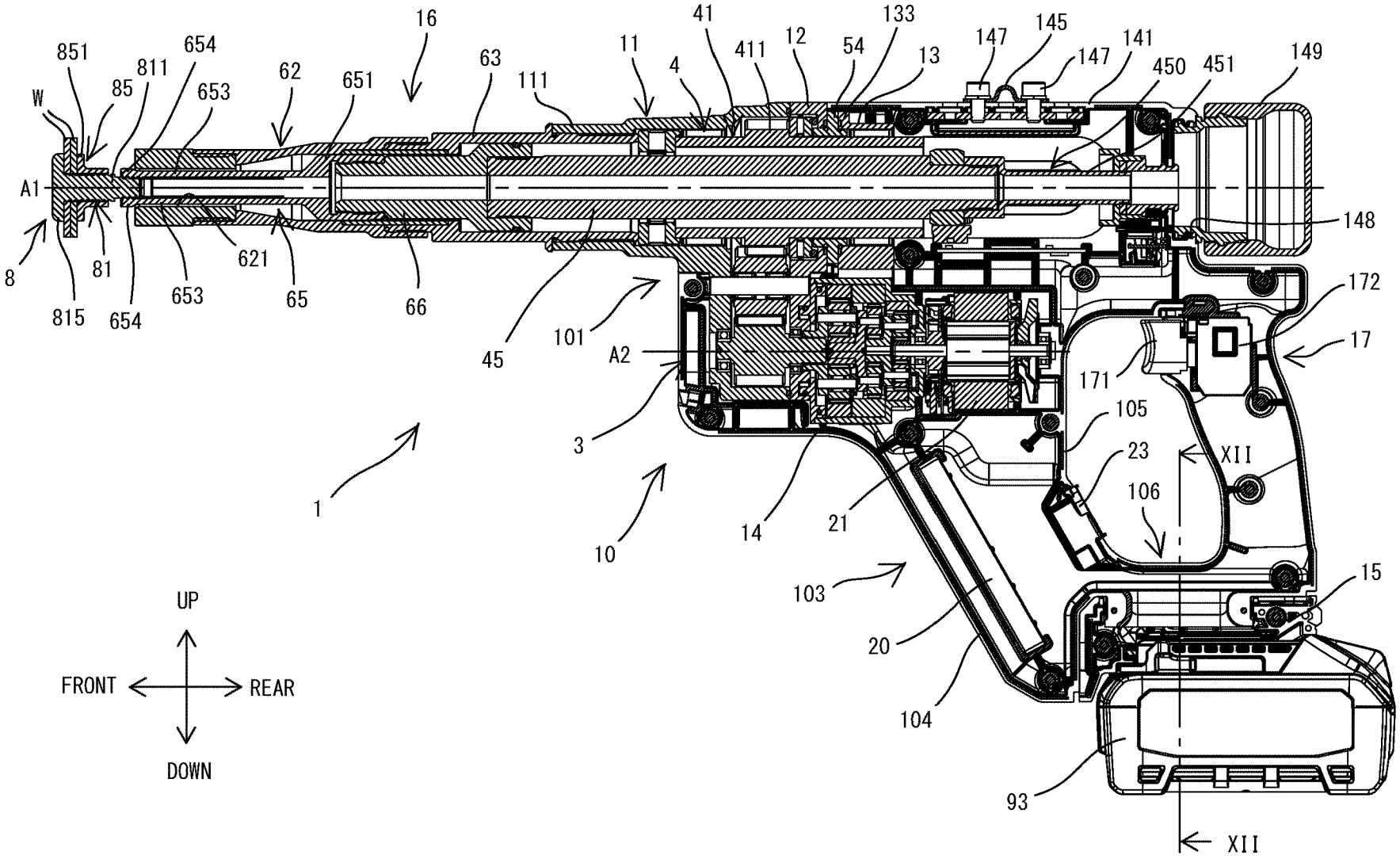
FIG. 1 is a cross-sectional view of a fastening tool.

In one or more embodiments of the present disclosure, the fastening tool may further include a first manipulation member that is configured to be externally manipulated by a user for activation of the motor. The first manipulation member may be disposed on the main handle and located on the rotational axis of the motor shaft. Such an arrangement of the first manipulation member can contribute to improved operability, by reliably leading a hand of a user to the portion of the main handle that is located in the rear space of the motor body.

In one or more embodiments of the present disclosure, a longitudinal end of the main handle may be located between the driving axis and the rotational axis of the motor in a direction that is orthogonal to the driving axis and the rotational axis.

In one or more embodiments of the present disclosure, the tool body may include a first portion that houses the motor and the fastening mechanism, and a second portion configured to removably hold a battery. Further, the first portion, the second portion, and the main handle may at least partially form the annular part. Further, in this aspect, two opposite ends of the main handle may be connected to the first portion and the second portion of the tool body, respectively. The tool body may include a third portion that is spaced frontward from the main handle and extends in a direction crossing the driving axis. The third portion may connect the first portion and the second portion. Further, the first portion, the second portion, the third portion and the main handle may together form the annular part. According to this aspect, reasonable arrangement of the main handle and the tool body to which the battery is mountable can be achieved.

In one or more embodiments of the present disclosure, the second portion may be spaced apart from the first portion and extend generally parallel to the driving axis. The third portion may extend obliquely rearward relative to the driving axis from the first portion to the second portion.

In one or more embodiments of the present disclosure, the fastening tool may further include a second manipulation member that is configured to be externally manipulated by a user for inputting information. Further, the second manipulation member may be disposed on the third portion and face the main handle. According to this aspect, the second manipulation member can be disposed at a position where the user can easily manipulate the second manipulation member from the rear while gripping the main handle.

In one or more embodiments of the present disclosure, the fastening tool may further include a controller that is configured to control operation of the fastening tool. Further, the controller may be disposed in the third portion. According to this aspect, an internal space of the third portion that connects the first portion, which houses the motor and the fastening mechanism, and the second portion, which holds the battery, can be effectively used to house the controller. Further, this configuration can facilitate wiring between the controller and the motor and between the controller and the battery. Further, in this aspect, the controller may have a length, a width, and a thickness, among which the length is the largest. The controller may be oriented such that a length direction (longitudinal direction) of the controller is oblique to the driving axis. According to this aspect, reasonable arrangement of the controller can be achieved without increasing the size of the third portion.

In one or more embodiments of the present disclosure, the fastening mechanism may include a ball-screw mechanism or a feed-screw mechanism that includes a hollow cylindrical nut and a shaft. The nut may be supported in the tool body to be rotatable around the driving axis and configured to be rotationally driven around the driving axis by the power of the motor. The shaft may be configured to move along the driving axis in response to rotational driving of the nut. The first portion may include a screw mechanism housing part that houses the ball-screw mechanism or the feed-screw mechanism, and a motor housing part that houses the motor. A rear end portion of the screw mechanism housing part may project further rearward relative to the motor housing part. A longitudinal end of the main handle may be connected to the rear end portion of the screw mechanism housing part.

In one or more embodiments of the present disclosure, the fastening tool may further include a battery holder that includes a first engagement part and a first terminal. The first engagement part may be physically engageable with a second engagement part of the battery. The first terminal may be electrically connectable to a second terminal of the battery. Further, the battery holder may be held by the second portion via an elastic member. According to this aspect, when the battery receives impact, the battery holder can move relative to the tool body to thereby reduce possible damage to the battery.

In one or more embodiments of the present disclosure, the tool body may include a mount part to which an auxiliary handle that is configured to be gripped by a user is mountable. According to this aspect, the user can mount the auxiliary handle on the mount part as needed, so that the user can hold the fastening tool stably by gripping the main handle and the auxiliary handle using both hands.

In one or more embodiments of the present disclosure, the fastening tool may further include an engagement member that is mounted to the tool body and that is engageable with a hanging member that is separate from (not a part of) the fastening tool. Further, the tool body may be configured such that a mount position at which the engagement member is mounted to the tool body is changeable. According to this aspect, for example, a user can hang the fastening tool using the hanging member that is engaged with the engagement member. This configuration can reduce the burden of the user to continuously hold the fastening tool at the same posture. Further, the user can appropriately change the mount position of the engagement member, depending on the actual posture of the fastening tool.

A fastening tool 1 according to an exemplary embodiment will be hereinafter described with reference to the drawings. The fastening tool 1 is an electric fastening tool that is capable of fastening workpieces using a fastener.

The fastening tool 1 can selectively use a multiple types of fasteners. A fastener 8 shown in FIG. 1 is exemplarily used in the following description. The fastener 8 is an example of a known fastener that is called a multi-piece swage type fastener. The fastener 8 is formed by a pin 81 and a collar 85.

The pin 81 includes a shaft (shank) 811, and a head 815 formed integrally with the shaft 811, at one end of the shaft 811. The collar 85 is a hollow cylindrical member, into which the shaft 811 can be inserted. A flange 851 is formed at one end of the collar 85. The pin 81 and the collar 85 are originally formed as separate members. When the pin 81 is pulled in its axial direction relative to the collar 85 by the fastening tool 1 and thereby the collar 85 is deformed, workpieces W are fastened between the head 815 of the pin 81 and collar 85 swaged onto the shaft 811 of the pin 81.

There are two types of the multi-piece swage type fasteners. The first type is a fastener of which a portion of the shaft of the pin (this portion is also referred to as a pintail or a mandrel) will be broken and torn off (hereinafter simply referred to as a tear-off or breakage type fastener). The second type is a fastener of which the shaft of the pin will be retained as it is without being torn off (hereinafter simply referred to as a non-tear-off type fastener). The fastener 8 is a non-tear-off type fastener.

The general structure of the fastening tool 1 is now described.

Figure 2:
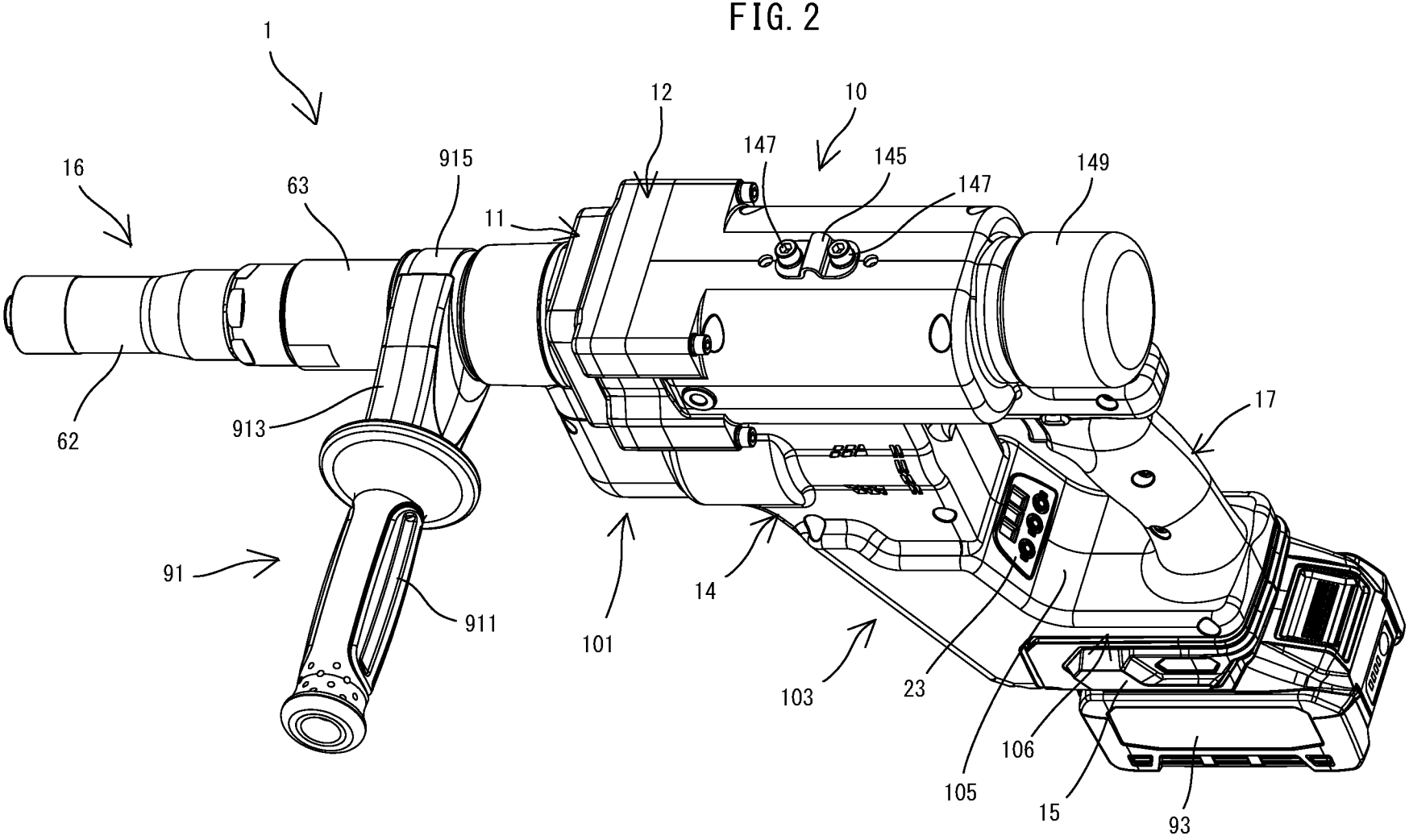
FIG. 2 is a perspective view of the fastening tool to which an auxiliary handle is mounted.

As shown in FIG. 1 and FIG. 2, an outer shell of the fastening tool 1 is mainly formed by a tool body 10, a handle 17, and a nose 16. The tool body 10 houses a motor 21, a driving mechanism 3, and the like. A battery 93 is attachable to the tool body 10. The fastening tool 1 is operated by electric power supplied from the battery 93. The handle 17 is an elongate tubular body that is configured to be held (gripped) by a user. Two opposite ends of the handle 17 are connected to the tool body 10. The tool body 10 and the handle 17 together form an annular part (a ring or a loop) having a generally D-shape as a whole. The nose 16 is connected (coupled, mounted) to the tool body 10 and extends along a driving axis A1. The handle 17 is located at an opposite side of the tool body 10 from the nose 16 in an extension direction of the driving axis A1, and extends in a direction that intersects (crosses) the driving axis A1 (specifically, in a direction that is substantially orthogonal to the driving axis A1). The handle 17 has a trigger 171 that is configured to be manually pulled (depressed) by the user.

When the user engages the fastener 8 with a front end portion of the nose 16 and pulls (depresses) the trigger 171, the motor 21 is driven. With the power generated by the motor 2, the driving mechanism 3 strongly pulls the pin 81 rearward relative to the collar 85, and causes the fastener 8 to deform, so that the workpieces W are fastened via the deformed fastener 8.

In the following description, for convenience of explanation, directions of the fastening tool 1 are related in the following manner. The extension direction of the driving axis A1 is defined as a front-rear direction of the fastening tool 1. In the front-rear direction, the side on which the nose 16 is located is defined as a front side, and the opposite side (the side on which the handle 17 is located) is defined as a rear side. A direction that is orthogonal to the driving axis A1 and that generally corresponds to a longitudinal direction of the handle 17 is defined as an up-down direction. In the up-down direction, the side on which one longitudinal end of the handle 17 close to the driving axis A1 is located is defined as an upper side, and the opposite side (the side on which the other longitudinal end of the handle 17 far from the driving axis A1 is located) is defined as a lower side. A direction that is orthogonal to both of the front-rear direction and the up-down direction is defined as a left-right direction.

The detailed structure of the fastening tool 1 is now described.

Firstly, the structures of the tool body 10 and the handle 17 are described.

As shown in FIG. 1 and FIG. 2, the tool body 10 includes a front housing 11, a center housing 12, a rear housing 13, and an outer housing 14 that are coupled (connected, joined) together.

The front housing 11 is a hollow body including a hollow cylindrical front portion and a rectangular box-like rear portion that is open to the rear. The center housing 12 is a generally rectangular support body that corresponds to the rear portion of the front housing 11. The center housing 12 is disposed at the rear side of the front housing 11. The rear housing 13 is a tubular body extending in the front-rear direction. The rear housing 13 has a rectangular flange part 133 protruding radially outward from a front end portion of the rear housing 13. The rear housing 13 is disposed at the rear side of an upper portion of the center housing 12. The front housing 11, the center housing 12, and the rear housing 13 are coupled (connected, joined) with each other in the front-rear direction to form a single (integral) unit, which mainly serves as a support that rotatably supports a nut 41, which will be described below. Each of the front housing 11, the center housing 12, and the rear housing 13 is made of metal (more specifically, aluminum alloy). The connecting structures between the front housing 11, the center housing 12, and the rear housing 13 will be described below.

The outer housing 14 is formed by coupling (connecting) two halves that are divided in the left-right direction. More specifically, the two (left and right) halves are connected with each other using screws (not shown) in a state in which upper portions of the front housing 11 and the center housing 12 are exposed to the outside, and lower portions of the front housing 11 and the center housing 12, as well as the rear housing 13 are held between the two halves. Thus, the outer housing 14 is connected with the front housing 11, the center housing 12, and the rear housing 13 to form a single (integral) unit. In this manner, in the present embodiment, the tool body 10, which serves as a single (integral) housing body, is formed from the front housing 11, the center housing 12, the rear housing 13, and the outer housing 14. The outer housing 14 is made of synthetic resin (polymer).

The tool body 10 includes a housing part 101, an extending part 103, and a battery holding part 106.

The housing part 101 is a portion of the tool body 10 that houses the motor 21 and the driving mechanism 3. An upper portion of the housing part 101 extends along the driving axis A1. The upper portion of the housing part 101 is longer than a lower portion of the housing part 101 in the front-rear direction. A rear end portion of the upper portion of the housing part 101 projects further rearward than a rear end of the lower portion. The housing part 101 includes the front housing 11, the center housing 12, the rear housing 13, and a portion of the outer housing 14.

A front end portion of the upper portion of the housing part 101 (a hollow cylindrical portion of the front housing 11 that is exposed to the outside from the outer housing 14) has a female thread, with which a connecting sleeve 63 is threadedly engaged, as will be described below. Also, the front end portion is formed as a mount part 111, on which an auxiliary handle 91 (see FIG. 2) is mountable.

Figure 3:
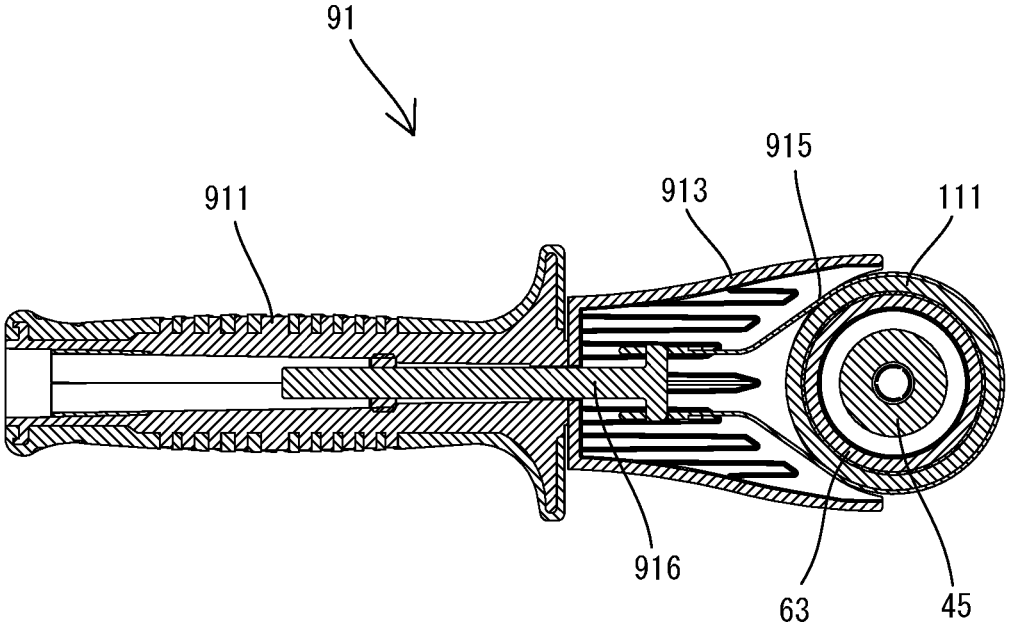
FIG. 3 is a cross-sectional view of the auxiliary handle.

The auxiliary handle 91 is a well-known handle (side grip) that can be mounted (installed) on a power tool by a user as needed and used in an auxiliary manner, in addition to the handle 17, which serves as a main handle. The structure of the auxiliary handle 91 is briefly described here. As shown in FIG. 2 and FIG. 3, the auxiliary handle 91 includes a grip 911, a contact part 913, and a belt 915. The grip 911 is an elongate portion to be gripped by a user. A projecting end portion of the contact part 913 has a semicircular section. The belt 915 is connected to the grip 911 via a bolt 916 and forms a loop. The user inserts the mount part 111 into a space formed by the projecting end portion of the contact part 913 and the belt 915, and then turns the grip 911 around its longitudinal axis relative to the contact part 913. The belt 915 is thus fastened, so that the auxiliary handle 91 is mounted on the power tool. The diameter of the mount part 111 is set such that an outer circumference of the mount part 111 generally conforms to the shape of the projecting end portion of the contact part 913. A length of the mount part 111 in the front-rear direction generally corresponds to a width of the belt 915.

A hook 145, which allows the fastening tool 1 to be used in a hanged state, is mounted (fixed) to an upper wall 141 of the housing part 101 (an upper wall of the outer housing 14). The hook 145 is a plate-like member including a U-shaped curved center portion. The hook 145 is fixed to the upper wall 141 using screws 147. In the present embodiment, the housing part 101 is formed such that a mount position, at which the hook 145 is mounted to the housing part 101, is changeable.

Figure 4:
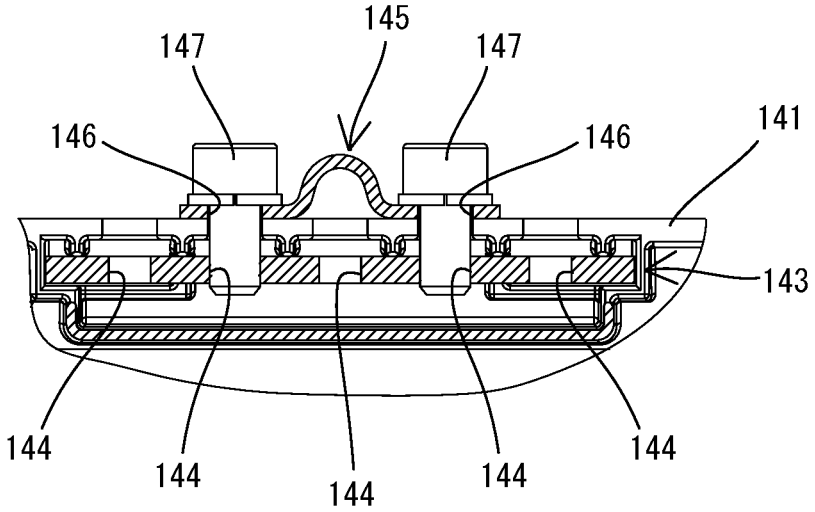
FIG. 4 is a partial enlarged view of FIG. 1.

Specifically, as shown in FIG. 4, a metal plate 143 is fixed to the housing part 101 below the upper wall 141. The plate 143 has five threaded holes (female threads) 144 that are formed at equal intervals on the center line in the left-right direction. Five matching through holes are formed in the upper wall 141 corresponding to the threaded holes 144.

Figure 5:
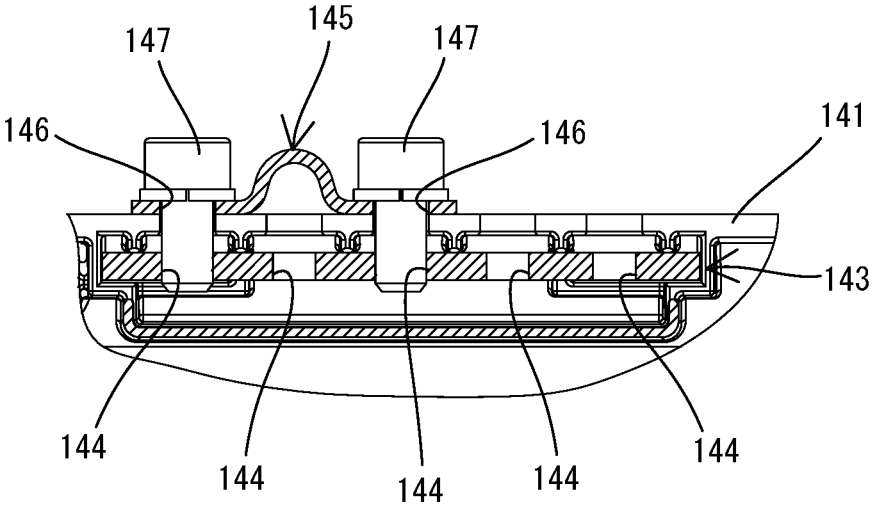
FIG. 5 is a view for explaining a hook wherein a mount position of the hook has been changed.

Two through holes 146 are respectively formed in two opposite end portions of the hook 145. A distance between the through holes 146 of the hook 145 is the same as a distance between two threaded holes 144 that are farthest among adjacent three of the threaded holes 144. Accordingly, three mount positions are available for the hook 145. For example, the user can remove the screws 147 and the hook 145 shown in FIG. 4, position the hook 145 such that the through holes 146 align with other two of the threaded holes 144 as shown in FIG. 5, and tighten the screws 117. In this manner, the user can easily change the mount position of the hook 145.

As shown in FIG. 1 and FIG. 2, the extending part 103 is a portion of the tool body 10 that protrudes from a lower end portion of the housing part 101 and extends in a direction that intersects the driving axis A1. More specifically, the extending part 103 extends obliquely rearward and downward as a whole from directly below a lower rear end portion of the housing part 101 (a housing space for the motor 21). The extending part 103 is a portion of the outer housing 14. The extending part 103 is a hollow portion and includes a pair of left and right side walls, a front wall 104, and a rear wall 105.

The battery holding part 106 is a portion of the tool body 10 that extends rearward from the lower end portion of the extending part 103. The battery holding part 106 is a portion of the outer housing 14. The battery holding part 106 is configured to removably hold (receive) the battery 93. In the present embodiment, a battery holder 15 is elastically connected to the battery holding part 106. The battery 93 is held by the battery holding part 106 via the battery holder 15. The battery holder 15 will be described below in detail.

Figure 6:
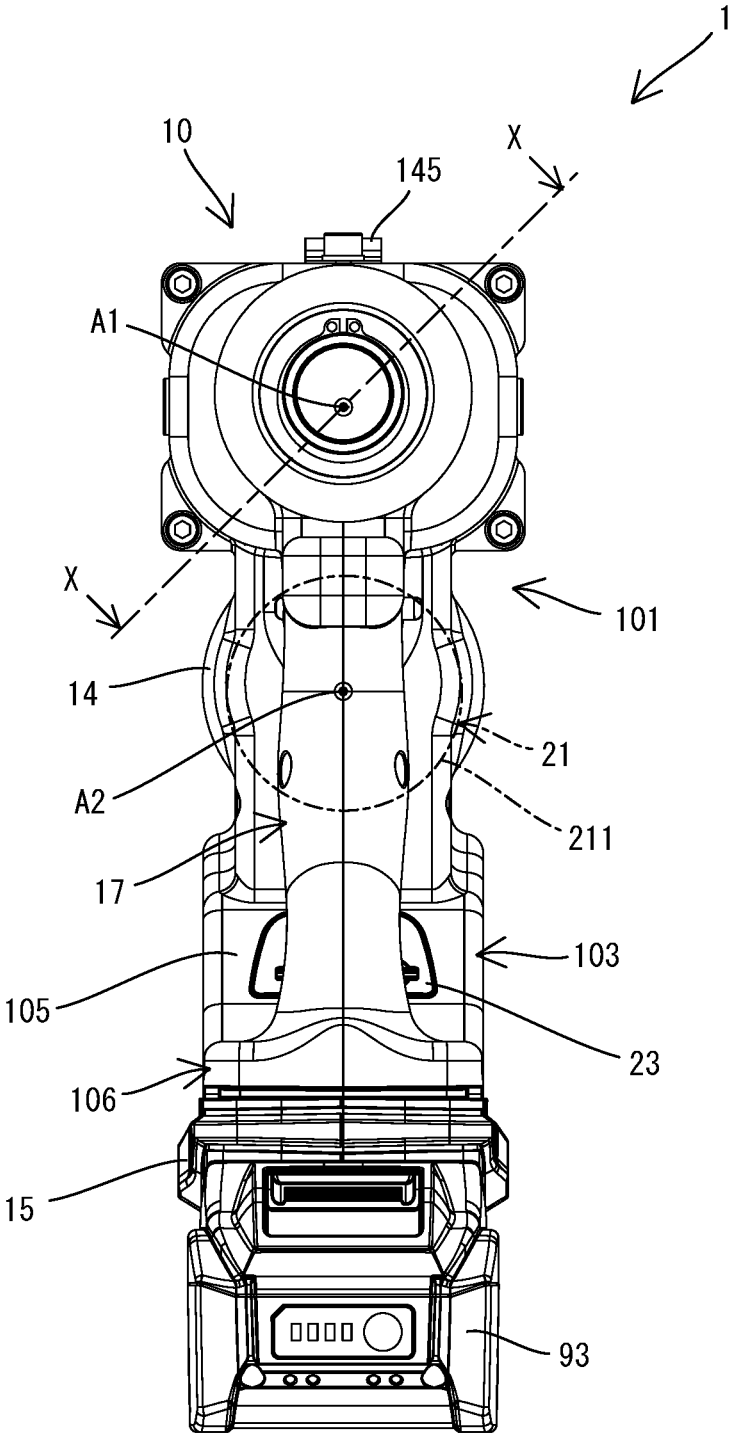
FIG. 6 is a rear view of the fastening tool.

As described above, the handle 17 is an elongate tubular body. As shown in FIG. 1, FIG. 2, and FIG. 6, the upper end of the handle 17 is connected to the rear end portion of the upper portion of the housing part 101 (i.e., to the portion that projects further rearward relative to the rear end of the lower portion of the housing 101). The lower end of the handle 17 is connected to the rear end portion of the battery holding part 106. Thus, the handle 17 is spaced rearward from the lower portion of the housing part 101 and the extending part 103, and extends in the up-down direction. In the present embodiment, the handle 17 is made of synthetic resin (polymer). The handle 17 is formed by coupling (connecting) left and right halves to each other via screws. The left and right halves of the handle 17 are formed integrally with the left and right halves of the outer housing 14, respectively.

With the configuration described above, the housing part 101 extending in the front-rear direction, the extending part 103 extending obliquely rearward and downward from the lower end portion of the housing part 101, the battery holding part 106 extending rearward from the lower end portion of the extending part 103, and the handle 17 having the upper and lower ends respectively connected to the upper rear end portion of the housing part 101 and the rear end portion of the battery holding part 106 together form the annular part (the ring/loop).

Structures (elements) disposed within the tool body 10 (the housing part 101, the battery holding part 106, and the extending part 103) are now described.

Firstly, structures and elements disposed within the housing part 101 are described.

Figure 7:
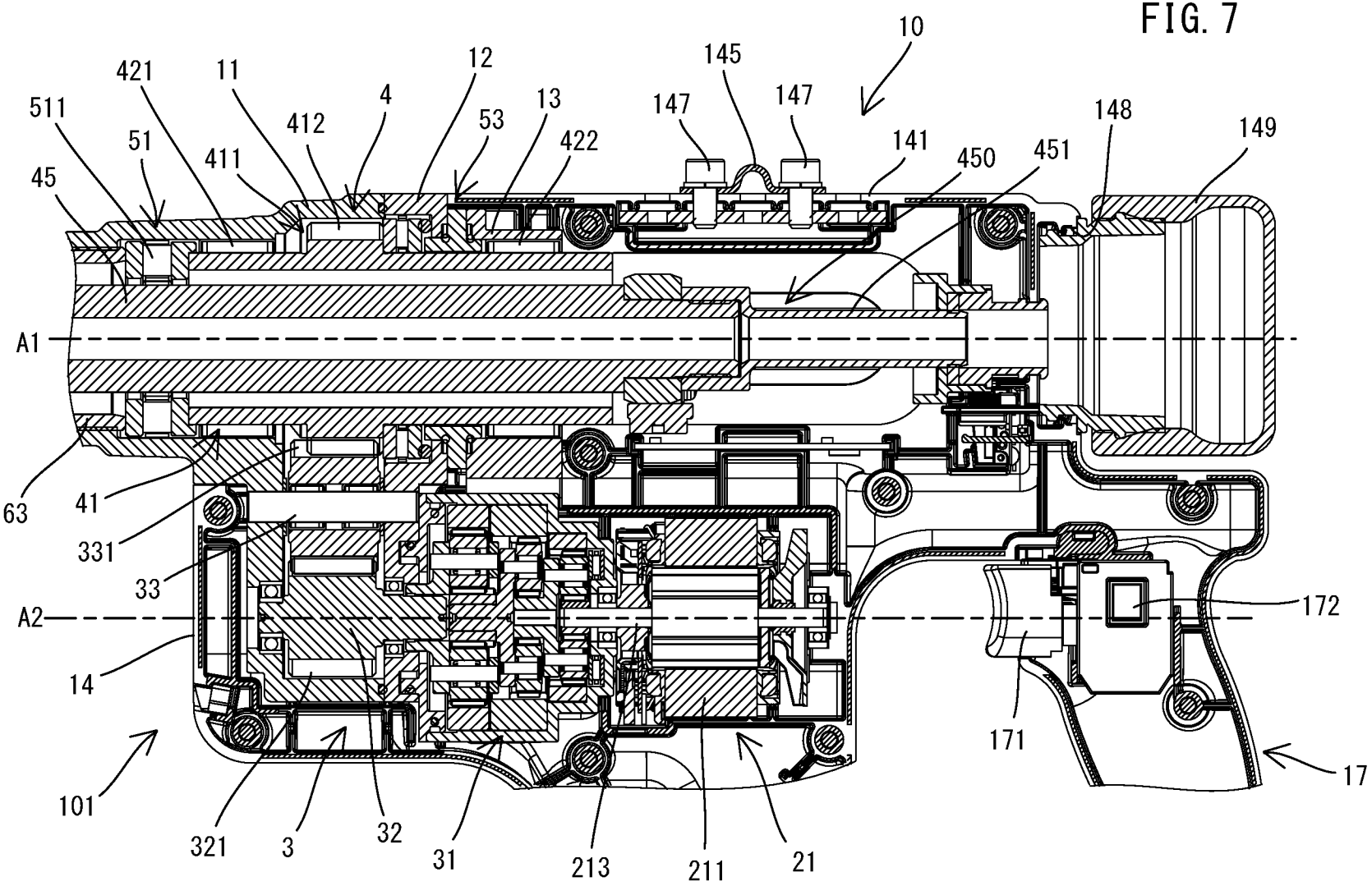
FIG. 7 is a partial enlarged view of FIG. 1.

As shown in FIG. 7, the motor 21 and the driving mechanism 3 are housed in the housing part 101. The motor 21 is disposed in the rear end portion of the lower portion of the housing part 101. In the present embodiment, a brushless DC motor is employed as the motor 21. The motor 21 includes a motor body 211, which includes a stator and a rotor, and a motor shaft 213, which extends from the rotor and rotates integrally with the rotor. A rotational axis A2 of the motor shaft 213 extends parallel to the driving axis A1 (i.e., in the front-rear direction), directly below the driving axis A1.

The driving mechanism 3 is configured to be driven by the motor 2 to move the pin 81 of the fastener 8 relative to the collar 85 in the front-rear direction. More specifically, the driving mechanism 3 is configured to move a pin-gripping part 65, which is configured to grip the pin 81, along the driving axis A1 relative to an anvil 62, which is fixed to the tool body 10. The driving mechanism 3 of the present embodiment includes a planetary-gear speed reducer 31, a driving gear 321 disposed on a first intermediate shaft 32, an idle gear 331 disposed on a second intermediate shaft 33, and a ball-screw mechanism 4.

The planetary-gear speed reducer 31 is disposed coaxially with the motor 21 in front of the motor 21 in the lower portion of the housing part 101. The planetary-gear speed reducer 31 is a speed reducer that includes planetary gear mechanisms. The planetary-gear speed reducer 31 is configured to increase torque inputted from the motor shaft 213 and outputs the increased torque to the first intermediate shaft 32. In the present embodiment, the planetary-gear speed reducer 31 is a three-stage planetary-gear speed reducer that includes three sets of planetary gear mechanisms. The structure of the planetary gear mechanism is well-known, and therefore the detailed description thereof is omitted.

The first intermediate shaft 32 extends frontward from the planetary-gear speed reducer 31 along the rotational axis A2 in the tool body 10. The first intermediate shaft 32 is rotatably supported by two bearings held in the front housing 11 and the center housing 12, respectively. The first intermediate shaft 32 is coupled to a carrier of the third planetary gear mechanism of the planetary-gear speed reducer 31 so as to rotate integrally with the carrier around the rotational axis A2. The driving gear 321 is formed integrally with an outer peripheral portion of the first intermediate shaft 32.

The second intermediate shaft 33 extends parallel to the first intermediate shaft 32 above the first intermediate shaft 32. A front end portion and a rear end portion of the second intermediate shaft 33 are fitted in and supported by support holes that are formed in the front housing 11 and the center housing 12, respectively. The idle gear 331 is supported by the second intermediate shaft 33 via a bearing to be rotatable relative to the second intermediate shaft 33. The idle gear 331 is meshed with the driving gear 321 and a driven gear 411 of the nut 41, which will be described below. The idle gear 331, however, does not affect the rotation speed ratio (the gear ratio) between the driving gear 321 and the driven gear 411.

The ball-screw mechanism 4 includes the nut 41 and a screw shaft 45. In the present embodiment, the ball-screw mechanism 4 is configured to convert rotation of the nut 41 into linear motion of the screw shaft 45 to thereby linearly move the pin-gripping part 65, which will be described below.

The nut 41 is an elongate hollow cylindrical member. The nut 41 is supported by the tool body 10 such that movement of the nut 41 in the front-rear direction is restricted and rotation of the nut 41 around the driving axis A1 is allowed. More specifically, a front end portion and a rear end portion of the nut 41 are rotatably supported by a bearing 421 supported by the front housing 11 and a bearing 422 supported by the rear housing 13, respectively. Each of the bearings 421 and 422 is a radial bearing.

The driven gear 411 is formed around the nut 41. The driven gear 411 is a circular flange-shaped portion that projects radially outward from an outer peripheral surface of the nut 41. Gear teeth 412 are formed on an outer circumference of (around) the driven gear 411 (the flange portion). The driven gear 411 is formed integrally with (not separable from) the nut 41. The driven gear 411 is located between the bearings 421 and 422 in the front-rear direction. More specifically, the driven gear 411 is located frontward of the center of the nut 41 in the axial direction (front-rear direction). With this arrangement, a portion of the nut 41 extending rearward of the driven gear 411 is relatively long, compared to a portion of the nut 41 extending frontward of the driven gear 411. Accordingly, a space between the rear bearing 422 and the driven gear 411 is larger than a space between the front bearing 421 and the driven gear 411 in the front-rear direction.

The screw shaft 45 is engaged with the nut 411 such that rotation of the screw shaft 45 around the driving axis A1 is restricted and movement of the screw shaft 45 in the front-rear direction along the driving axis A1 is allowed. More specifically, the screw shaft 45 is an elongate body that is inserted into the nut 41 so as to extend along the driving axis A1. Although not shown in detail, a track is defined by a spiral groove formed in an inner peripheral surface of the nut 41 and a spiral groove formed in an outer peripheral surface of the screw shaft 45. Many balls are rollably disposed within the track. The screw shaft 45 is engaged with the nut 41 via these balls.

Figure 8:
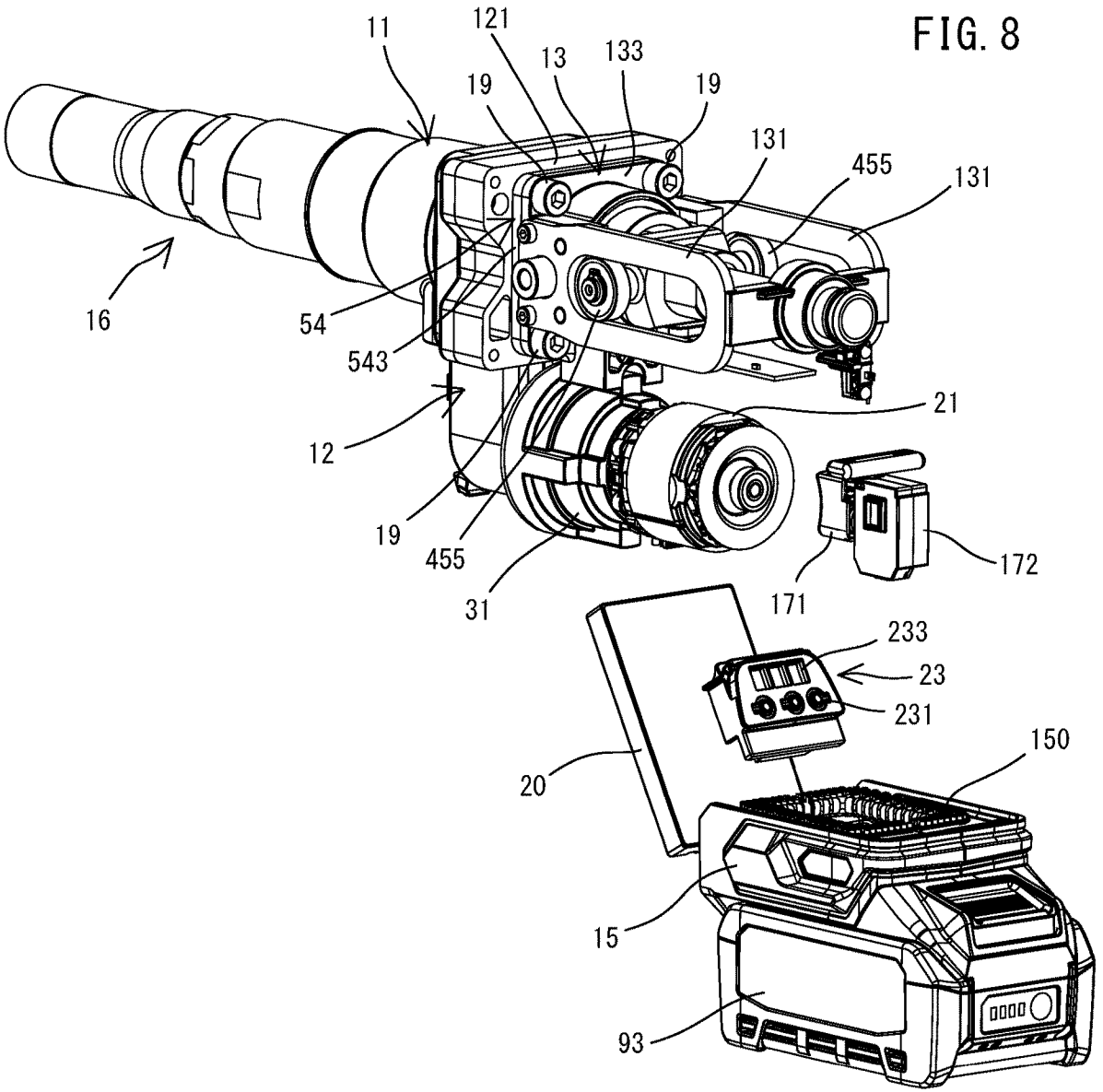
FIG. 8 is a perspective view of the fastening tool wherein an outer housing has been removed.

As shown in FIG. 8, two arms extend to the left and to the right, respectively, from the rear end portion of the screw shaft 45. Bearings 455 are mounted on distal end portions of these arms. A pair of left and right guide members 131 is fixed to the tool body 10 (specifically, the rear housing 13). The bearings 455 are each disposed in a guide groove formed in the guide member 131. With such a configuration, when the nut 41 rotates around the driving axis A1, the screw shaft 45 moves linearly in the front-rear direction relative to the nut 41 and the tool body 10.

As shown in FIG. 7, an extension shaft 451 is fixed to the rear end portion of the screw shaft 45 and extends coaxially with the screw shaft 45. Thus the extension shaft 451 is integrated with the screw shaft 45. The screw shaft 45 and the extension shaft 451 integrated with each other are hereinafter also collectively referred to as a driving shaft 450.

Although not described in detail, the fastening tool 1 of the present embodiment is capable of fastening workpieces using, not only the non-tear-off type fastener 8, but also the tear-off type fastener, by replacing the anvil 62 and the pin-gripping part 65 (see FIG. 1) described below. Thus, as shown in FIG. 1, the driving shaft 450 has a through hole that extends through the driving shaft 450 along the driving axis A1. The through hole serves as a passage through which the pintail torn off from the tear-off type fastener travels. An opening 148 having a circular section is formed in a rear wall of the upper portion of the housing part 101. When the non-tear-off type fastener 8 is used, a cap 149 is detachably attached to the rear wall to cover the opening 148. Although not described or shown in detail, when the tear-off type fastener is used, a container that is capable of accommodating pintails is attached to the housing part 101, instead of the cap 149.

In a fastening process, when the screw shaft 45 is moved in the front-rear direction relative to the nut 14, a large axial force (also referred to as a thrust load) is applied to the nut 41, as a reaction force, in the extension direction of the driving axis A1 (in the front-rear direction). To cope with this force, as shown in FIG. 7, a front receiving part 51, which is configured to receive a frontward reaction force applied to the nut 41, is disposed in front of the nut 41 in the front-rear direction. Further, a rear receiving part 53, which is configured to receive a rearward reaction force applied to the nut 41, is disposed in the space between the rear bearing 422 and the driven gear 411 described above.

The front receiving part 51 includes a thrust bearing 511 disposed between a rear end surface of the connecting sleeve 63 coupled to the tool body 10 and the front end surface of the nut 41 in the front-rear direction. More specifically, the thrust bearing 511 includes two (front and rear) races (rings) and multiple rolling elements arranged between the races (rings). The front and rear races are in contact with the rear end surface of the connecting sleeve 63 and the front end surface of the nut 41, respectively. With such an arrangement, in the fastening process, the thrust bearing 511 receives the frontward reaction force from the nut 41 that is caused in response to rearward movement of the screw shaft 45 and transmits the reaction force to the connecting sleeve 63 while allowing smooth rotation of the nut 41.

Figure 9:
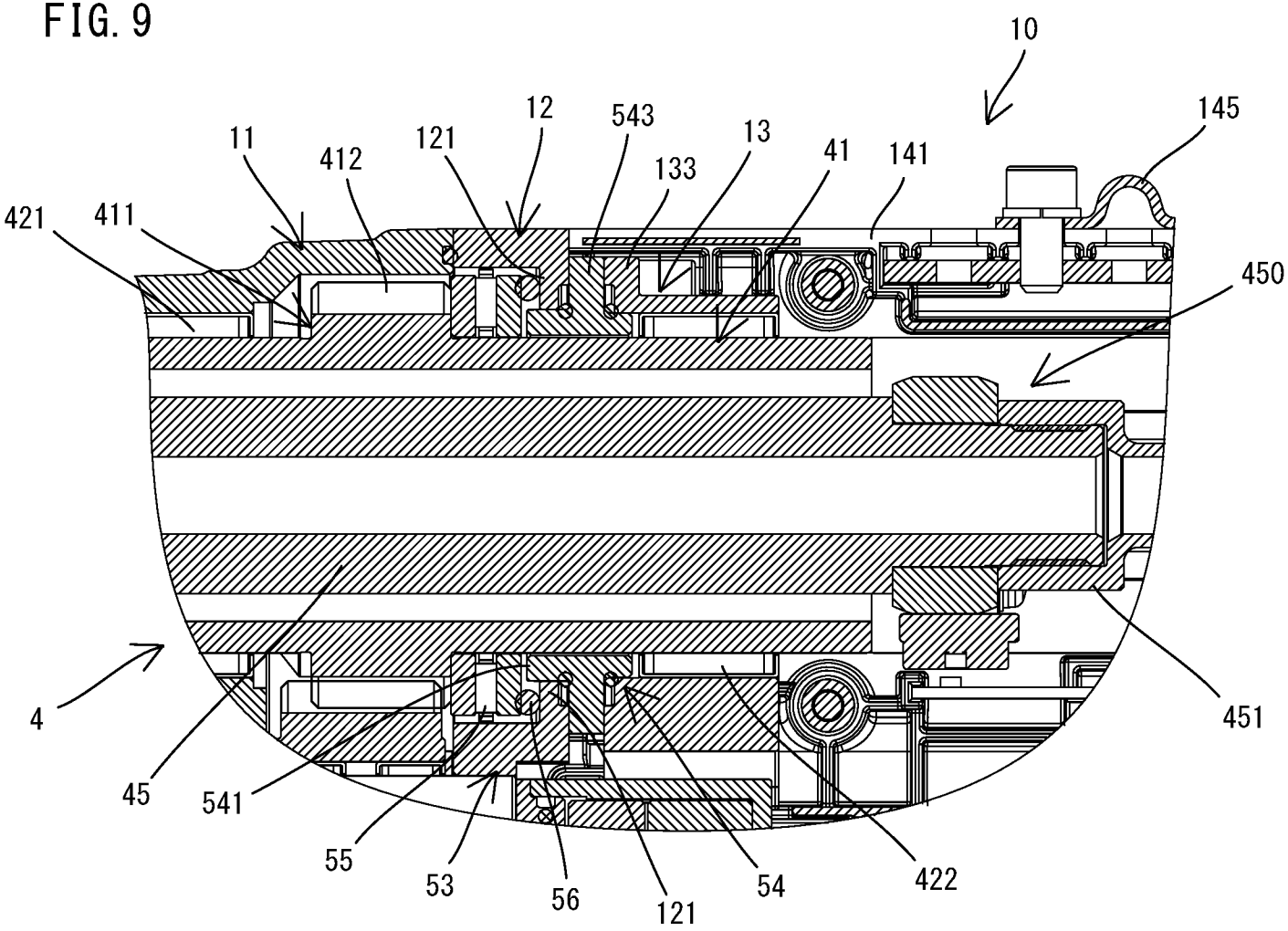
FIG. 9 is a partial enlarged view of FIG. 1.

As shown in FIG. 9, the rear receiving part 53 is disposed rearward of (behind) the rear end surface of the driven gear 411 in the front-rear direction. In the present embodiment, the rear receiving part 53 includes a receiving member 54, a thrust bearing 55 disposed between the driven gear 411 and the receiving member 54, and an elastic member 56 interposed between the thrust bearing 55 and the receiving member 54.

The receiving member 54 is configured to receive the rearward reaction force from the nut 41 that is caused in response to frontward movement of the screw shaft 45 via the rear end surface of the driven gear 411 in the fastening process. The receiving member 54 is located rearward of the rear end surface of the driven gear 411. The rear end of the receiving member 54 is located frontward of the rear end of the nut 41 (more specifically, in front of the rear bearing 422). The receiving member 54 is made of metal. In the present embodiment, in order to secure sufficient strength, the receiving member 54 is made of iron (or alloy containing iron as a main component).

Figure 10:
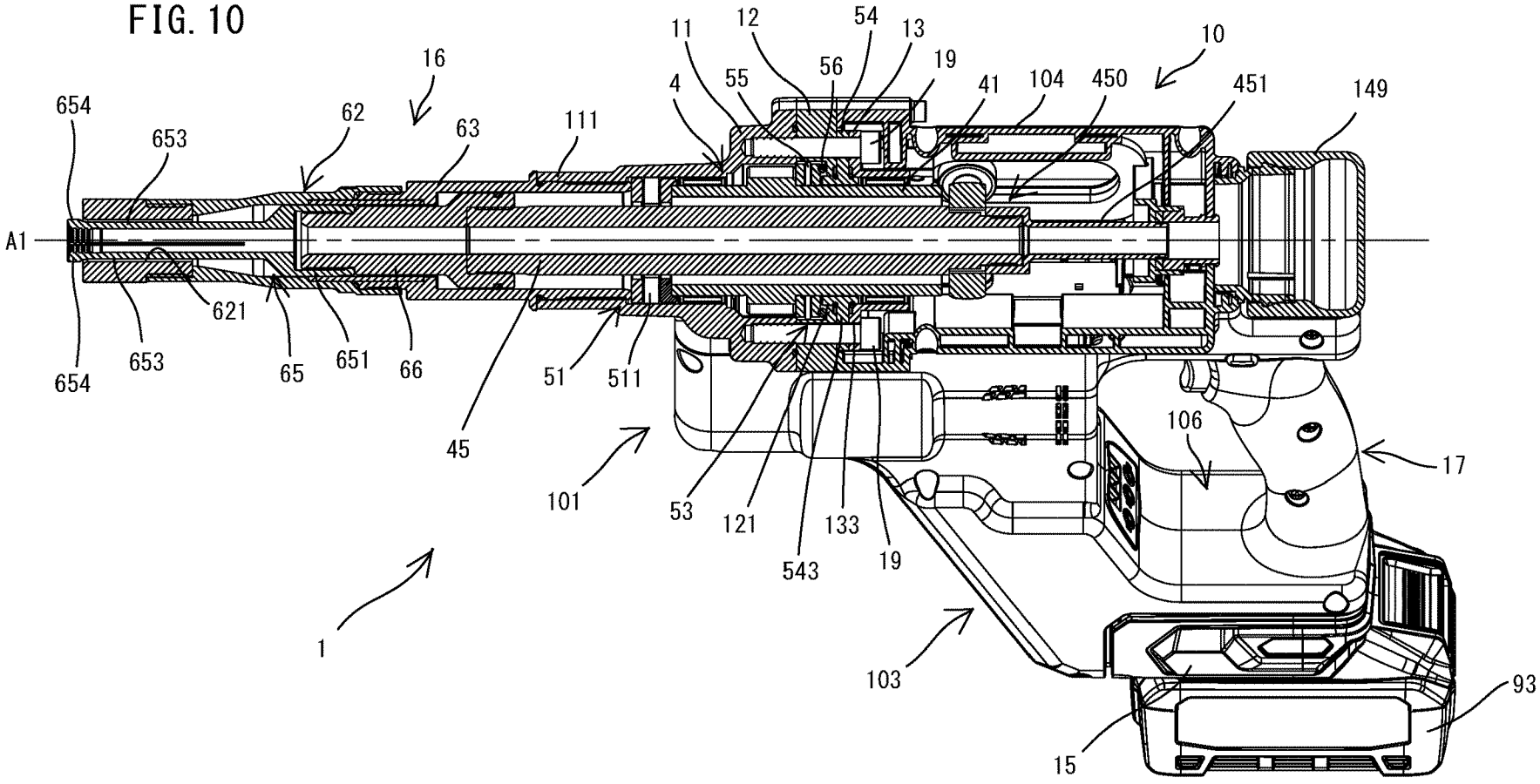
FIG. 10 is a cross-sectional view taken along line X-X in FIG. 6.

As shown in FIG. 8 through FIG. 10, the receiving member 54 is fixed to the front housing 11 of the tool body 10 using screws 19. More specifically, the receiving member 54 includes a hollow cylindrical body 541 and a rectangular plate-like connection part 543 that projects radially outward from the body 541.

As described above, the front housing 11, the center housing 12, and the rear housing 13 are coupled (connected) to each other in the front-rear direction. The receiving member 54 is arranged such that the connection part 543 is sandwiched between the rear wall 121 of the center housing 12 and the flange part 133 of the rear housing 13 in the front-rear direction and a front end portion and a rear end portion of the body 541 project into the center housing 12 and the rear housing 13, respectively. Through holes are formed in each of the flange part 133 of the rear housing 13, in the connection part 543 of the receiving member 54, and in the rear wall 121 of the center housing 12. The screws 19 are inserted through the respective through holes of the flange part 133, the connection part 543 and the rear wall 121 from behind the flange part 133, and screwed into (threadedly engaged with) threaded holes that are correspondingly formed in the front housing 11. In this manner, the receiving member 54 is fixed to the front housing 11 together with the center housing 11 and the rear housing 13, using the screws 19 tightened from the rear. This configuration facilitates assembling of the receiving member 54 with the tool body 10, and assembling of the front housing 11, the center housing 12, and the rear housing 13.

As shown in FIG. 9, in the present embodiment, in order to secure smooth rotation of the nut 41, the receiving member 41 receives the reaction force (axial force) from the nut 41 via the thrust bearing 55. Thus, the thrust bearing 55 is disposed between the driven gear 411 and the receiving member 54 in the front-rear direction. In the present embodiment, in the thrust bearing 511 (see FIG. 7) of the front receiving part 51, cylindrical rollers are employed as rolling elements. In the thrust bearing 55 of the rear receiving part 53, needle rollers are employed as rolling elements. This difference is based on the fact that the rearward reaction force that is applied to the nut 41 when the screw shaft 45 is returned frontward is smaller than the frontward reaction force that is applied when the screw shaft 45 strongly pulls the pin 81 while moving rearward in the fastening process. Therefore, it is reasonable that the thinner needle rollers are employed in the thrust bearing 55 in order to save space in the axial direction (front-rear direction).

The elastic member 56 is a annular (ring-shaped or loop-shaped) rubber member (a so-called O-ring) interposed between the thrust bearing 55 and the connection part 543 of the receiving member 54 in the front-rear direction. More specifically, the elastic member 56 is disposed in a slightly compressed (loaded) state between the thrust bearing 55 and the rear wall 121 fixed to the front side of the connection part 543. When the rearward reaction force is not applied to the nut 41, the thrust bearing 55 is held at a position where a front race (ring) of the thrust bearing 55 is in contact with the rear end surface of the driven gear 411 (more specifically, the rear end surface of a base portion of the driven gear 411 that is located radially inward (at a side closer to the driving axis A1) of the gear teeth 412), by a biasing force of the elastic member 56. At this time, the thrust bearing 55 (specifically, a rear race (ring) of the thrust bearing 55) and the receiving member 54 (specifically, the body 541) are slightly spaced apart from each other in the front-rear direction. Thus, when the rearward reaction force is not applied to the nut 41, there is a slight gap between the thrust bearing 55 and the receiving member 54.

Figure 16:
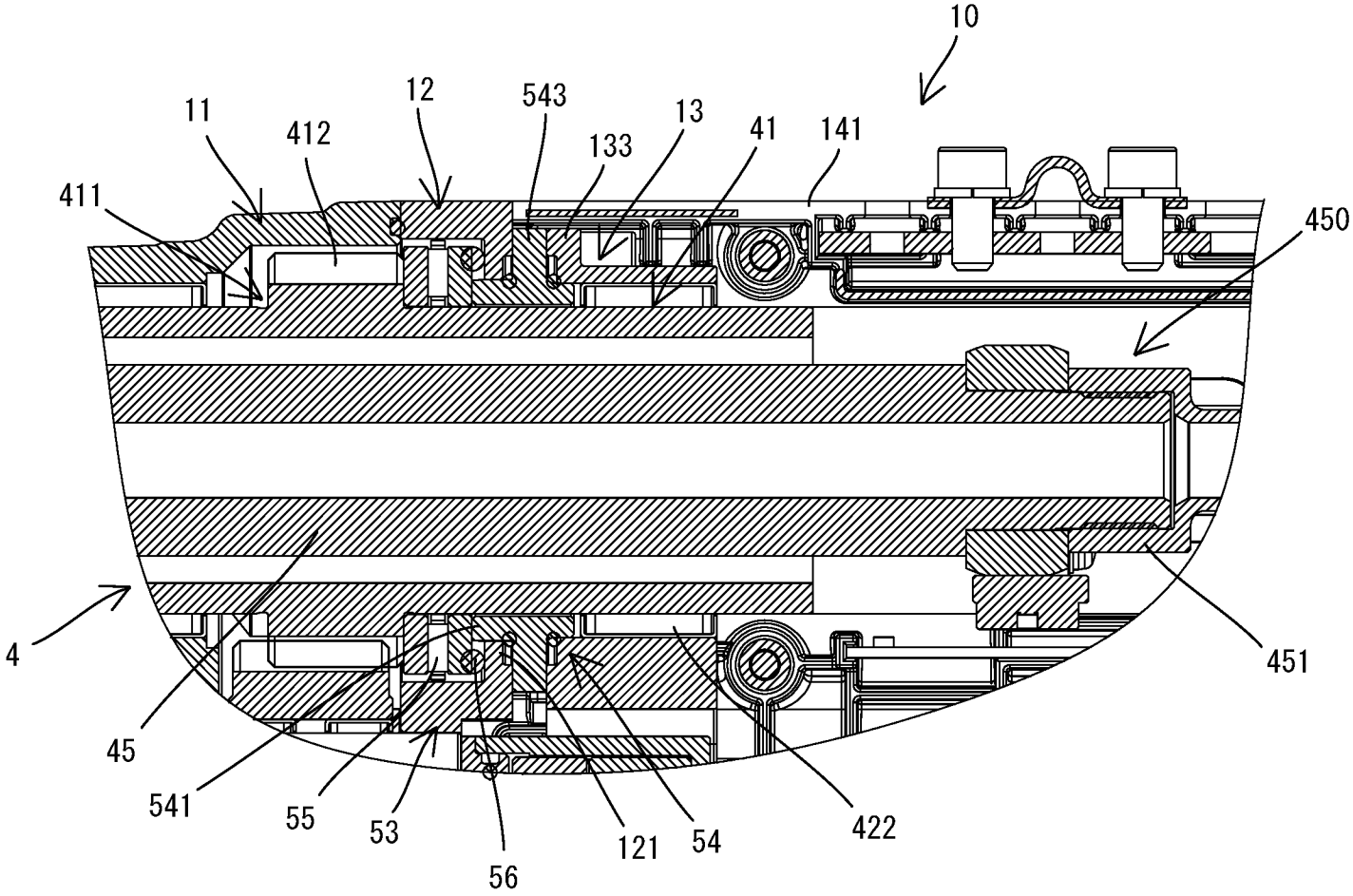
FIG. 16 is a partial enlarged view of FIG. 15.

As will be described in detail below, when the rearward reaction force is applied to the nut 41, the elastic member 56 allows the nut 41 and the thrust bearing 55 to move rearward to a position where the thrust bearing 55 (specifically, the rear end surface of the rear race) is in contact with the receiving member 54 (specifically, the front end surface of the body 541) (see FIG. 16).

In this manner, in the present embodiment, the receiving member 54 receives the rearward reaction force applied to the nut 41 via the driven gear 411, at the rear side of the driven gear 411. In particular, in the present embodiment, the rear end of the receiving member 54 is located forward of the rear end of the nut 41. Thus, compared to an embodiment in which the reaction force is received at the rear side of the rear end surface of the nut 41, the fastening tool 1 can be made compact in the front-rear direction.

If the fastening tool 1 is assembled such that the receiving member 54 and the thrust bearing 55 are in contact with each other, high dimensional accuracy is required for each of the receiving member 54 and the thrust bearing 55. In addition, in the present embodiment, since the receiving member 54 is connected to the front housing 11 with the center housing 12 interposed between the receiving member 54 and the front housing 11, an error may be caused in the assembling. In the present embodiment, however, the receiving member 54 and the thrust bearing 55 are arranged with the elastic member 56 therebetween, such that the receiving member 54 and the thrust bearing 55 are spaced apart from each other when the rearward reaction force is not applied to the nut 41 and come into contact with each other when the reaction force is applied to the nut 41. As a result, such high dimensional accuracy is not required for each of the receiving member 54 and the thrust bearing 55. Thus, manufacturing and assembling of the fastening tool 1 can be facilitated.

Structures (elements) disposed within the battery holding part 106 are now described.

Figure 11:
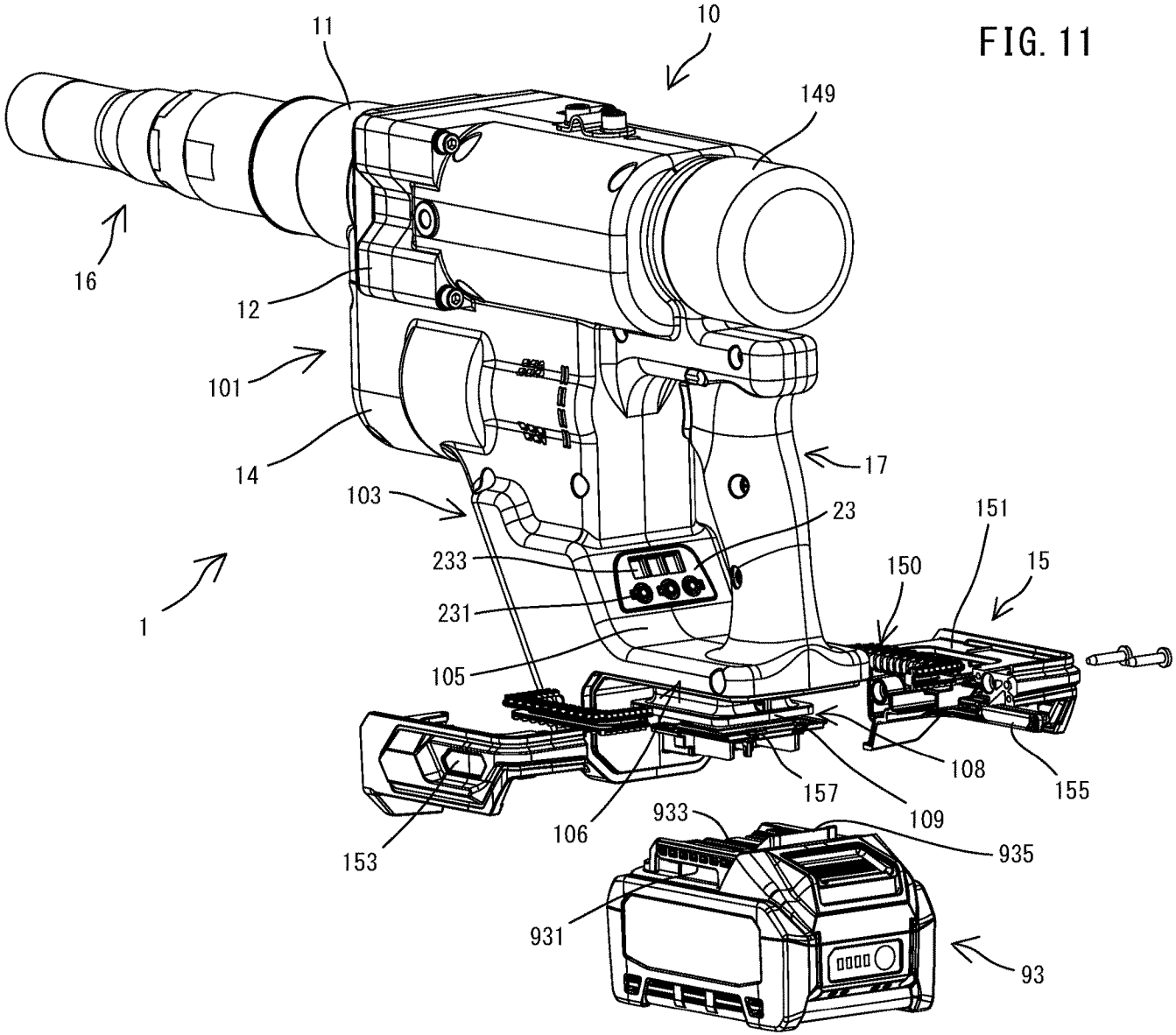
FIG. 11 is a partially-exploded perspective view of the fastening tool wherein a battery holder and an elastic member are separated.
Figure 12:
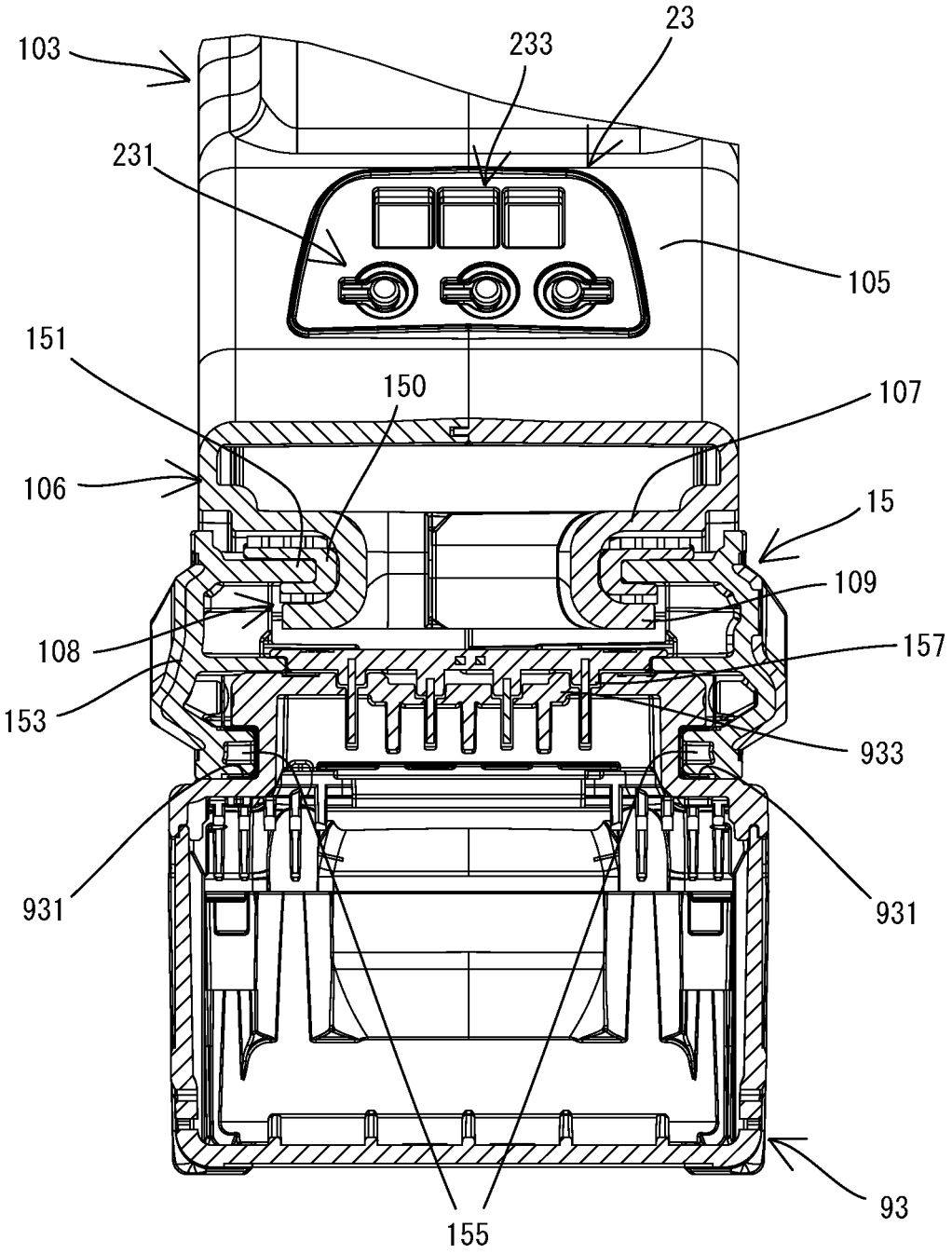
FIG. 12 is a cross-sectional view taken along line XII-XII in FIG. 1.

As described above, the battery holder 15 is elastically connected to the battery holding part 106. As shown in FIG. 8, FIG. 11, and FIG. 12, the battery holder 15 and the battery holding part 106 are separate (discrete) members that were separately formed. The battery holder 15 is held by the battery holding part 106 via an elastic member 150.

More specifically, the battery holding part 106 includes a pair of left and right side walls, an upper wall, a bottom wall 107, and a projecting part 108 that projects downward from a center portion of the bottom wall 107. The projecting part 108 has a generally parallelepiped shape. A lower end portion of the projecting part 108 has a rectangular flange part 109 projecting outward. The elastic member 150 has a generally rectangular loop shape. The elastic member 150 is fitted around an outer circumference of the projecting part 108 and held between the bottom wall 107 and the flange part 109. A groove is formed around the whole circumference of the elastic member 150. The battery holder 15 has a rectangular frame-like upper wall 151, and a peripheral wall 153 projecting downward from the upper wall 151. An inner peripheral edge portion of the upper wall 151 is fitted into the groove of the elastic member 150 and thus the battery holder 15 is connected to the projecting part 108 via the elastic member 105. With this elastic connecting structure, the battery holder 15 is movable relative to the battery holding part 106 in all directions including the front-rear direction, the left-right direction, and the up-down direction.

The battery holder 15 has structures for removably holding the battery 93. The battery 93 is a rechargeable battery (also called a battery pack) having well-known structures. Specifically, the battery 93 has two engagement grooves 931 that are respectively formed in its side walls, and terminals 933 that are disposed on its upper end portion. Correspondingly, the battery holder 15 has two rails 155 that are engageable the engagement grooves 931 of the battery 93, and a terminal block 157 having terminals that are electrically connectable to the terminals 933 of the battery 93.

The rails 155 are provided on lower end portions of the left and right side walls of the peripheral wall 153 of the battery holder 15. The rails 155 project inward and extend in the front-rear direction such that the rails 155 are slidably engageable with the engagement grooves 931 of the battery 93. The terminal block 157 is held at the center of the lower end portion of the battery holder 15. The battery 93 can be slid frontward from the rear side of the battery holder 15 while the engagement grooves 931 and the rails 155 are engaged with each other. When the battery 93 is placed in a predetermined position, the terminals 933 of the battery 93 and the terminals of the terminal block 157 are electrically connected with each other. A hook 935 that is movable in the up-down direction is disposed on the upper end portion of the battery 93. When the battery 93 is placed at the predetermined position, the hook 935 engages with an engagement recess (not shown) of the battery holder 15, so that the battery 93 is prevented from coming off from the battery holder 15.

In the present embodiment, each of the elastic member 150 and the battery holder 15 is formed by left and right halves connected with each other. In mounting the battery holder 15 to the tool body 10, firstly, the left and right halves of the elastic member 150 are fitted between the bottom wall 107 and the flange part 109 from the left and right of the projecting part 108, respectively. Further, the left and right halves of the battery holder 15 are connected with each other using screws, so that the terminal block 157 is held between the left and right halves and the upper wall 151 is fitted into the groove of the elastic member 150. In this manner, the battery holder 15 is elastically connected to the tool body 10 (the battery holding part 106).

When the fastening tool 1 is dropped with the battery 93 mounted to the battery holder 15, for example, and the battery 93 is subjected to impact, the battery holder 15 moves together with the battery 93 relative to the tool body 10 while elastically deforming the elastic member 150. Thus, the impact to the battery 93 is cushioned, and possible damage to the battery 93 can be reduced.

Structures (elements) disposed within the extending part 103 are now described.

As shown in FIG. 1, the extending part 103 houses a controller 20 that controls the operation of the fastening tool 1. A space within the extending part 103 communicates with a space within the housing part 101 that houses the motor 21 and the driving mechanism 3 and also with a space within the battery holding part 106 to which the battery 93 is attachable. Thus, this configuration facilitates wiring between the controller 20 and the motor 21, between the controller 20 and the terminals of the battery holder 15, and the like. Although not shown in detail, the controller 20 includes a case, a circuit board disposed in the case, and a control circuit mounted on the circuit board. In the present embodiment, the control circuit is formed as a microcomputer including a CPU, a ROM, a RAM, a timer and the like, and controls the operation of the fastening tool 1 including driving of the motor 21.

The controller 20 as a whole has a substantially parallelepiped shape, having a length, a width, and a thickness. The length is the largest and the thickness is the smallest among the length, the width, and the thickness of the controller 20. The controller 20 is disposed adjacent to the front wall 104 in the extending part 103. The controller 20 is oriented such that its longitudinal direction (length direction) is oblique to the driving axis A1. In the present embodiment, the controller 20 is arranged such that its longitudinal direction coincides with the extension direction of the extending part 103. A width direction of the controller 20 coincides with the left-right direction of the extending part 103. A thickness direction of the controller 20 coincides with a direction in which the front wall 104 and the rear wall 105 face (oppose) each other. Since the extending part 103 extends obliquely relative to the driving axis A1, a long distance can be most easily secured in its extension direction. Thus, by setting the orientation of the controller 20 as described above, a rational arrangement of the controller 20 in the extending part 103 is achieved while the width in the left-right direction and the thickness in the front-rear direction of the extending part 103 are suppressed.

As shown in FIG. 11 and FIG. 12, a manipulation and display part 23 is disposed on the extending part 103. The manipulation and display part 23 includes a manipulation part 231 that is configured to receive various information inputs in response to an external manipulation by the user, and a display part 233 that is configured to display various information. The manipulation and display part 23 is disposed on the rear wall 105 of the extending part 103 (i.e., on a surface that faces (opposes) the handle 17), such that the user can visually recognize and/or manipulate the manipulation and display part 23 from the rear.

In the present embodiment, the manipulation part 231 includes a plurality of push-button switches. The user can input, for example, a control condition for the motor 21 (for example, a target value of a driving current of the motor 21 according to a type of a fastener to be used) by manipulating the manipulation part 231. The manipulation part 231 is connected to the controller 20 via wires, which are not shown, and outputs a signal, which indicates the inputted information, to the controller 20. The display part 223 includes a plurality of seven-segment LEDs. The display part 233 is connected to the controller 20 via wires, which are not shown, and displays various information (for example, information relating to the set control condition for the motor 21) in response to control signals from the controller 20.

The detailed arrangement of the handle 17 and structures (elements) disposed within the handle 17 are now described.

As shown in FIG. 1, the trigger 171 is disposed at the front surface side of the upper end portion of the handle 17. As described above, the upper end of the handle 17 is connected to the rear end portion of the upper portion of the housing part 101. Thus, the upper end portion of the handle 17 is located in a rear space that extends behind (rearward of) the lower portion of the housing part 101, i.e., in a rear space of the motor 21 (the motor body 211). The rear space of the motor body 211 may also be defined as a space that is occupied by projection of the motor body 211 when the motor body 211 is projected rearward. Accordingly, as shown in FIG. 6, the upper end portion of the handle 17 overlaps with a region that is enclosed (defined) by the outer circumference of the motor body 211 (a region that is enclosed (defined) by the outer circumference of the stator) when viewed from the rear. Further, as shown in FIG. 1, the trigger 171 is located on the rotational axis A2 of the motor shaft 213 (i.e., the rotational axis A2 intersects the trigger 171). The center portion and the lower end portion of the handle 17 are located in a rear space of the extending part 103.

The handle 17 is relatively thin (has a relatively small diameter) so that it can be easily gripped by the user. A distance between handle 17 and the tool body 10 (the lower portion of the housing part 101 and the extending part 103) is set such that a sufficient gap (space) is formed between a hand of the user and the tool body 10 when the user grips the handle 17. Further, as shown in FIG. 6, a width in the left-right direction of the extending part 103 is larger than a width of the handle 17. The manipulation and display part 23 is provided on the rear wall 105 of the extending part 103 to face (oppose) the lower end portion of the handle 17, so that the manipulation part 231 can be manipulated from the rear. With such a configuration, the user can easily visually check the manipulation part 231 while gripping the handle 17 and thus can easily manipulate the manipulation part 231.

As shown in FIG. 1, a switch 172 is disposed in the handle 17, adjacent to the rear side of the trigger 171. The switch 172 is normally kept OFF, and turned ON in response to depressing manipulation of the trigger 171. The switch 172 is electrically connected to the controller 20 (control circuit)

via wires, which are not shown. When the switch 172 is turned ON, the switch 172 outputs an ON signal to the controller 20.

The detailed structure of the nose 16 is now described. As shown in FIG. 1 and FIG. 10, the nose 16 includes the anvil 62, the connecting sleeve 63, the pin-gripping part 65, and a connecting member 66.

The anvil 62 is an elongate hollow cylindrical body that is engageable with (or abuttable on) the collar 85 of the fastener 8. The anvil 62 has a bore 621 that extends in an axial direction of the anvil 62. Although the diameter of the bore 621 is generally uniform in a front portion of the anvil 62, in its front end region, the diameter gradually increases toward the front end. Thus, an inner circumferential surface of the front end portion of the anvil 62 includes a tapered surface. In a rear portion of the anvil 62, the diameter of the bore 621 gradually increases toward the rear to a predetermined position and is uniform between the predetermined position and the rear end. In the present embodiment, although the anvil 62 is formed by connecting separate (discrete) members with each other, an entirety of the anvil 62 may be formed as a single (integral) member.

The anvil 62 is coupled to the tool body 10 via the connecting sleeve 63, and extends along the driving axis A1. The connecting sleeve 63 is an elongate hollow cylindrical body. A rear end portion of the connecting sleeve 63 is screwed into the mount part 111 of the tool body 10 (the hollow cylindrical portion of the front housing 11 that is exposed to the outside from the outer housing 14). A front end portion of the connecting sleeve 63 is screwed into the rear end portion of the anvil 62.

The pin-gripping part 65 is configured to grip (hold) the pin 81 of the fastener 8. The pin-griping part 65 is held to be movable relative to the anvil 62 in the front-rear direction along the driving axis A1. The pin-gripping part 65 includes a base part 651 and a plurality of claws 653. The base part 651 and the claws 653 are formed integrally with each other.

The base part 651 is a tubular portion that is slidable in the rear portion of the anvil 62. The base part 651 is connected to the screw shaft 45 via the connecting member 66. The connecting member 66 is a tubular member that is slidable in the connecting sleeve 63. The rear end portion of the connecting sleeve 63 is screwed onto the front end portion of the screw shaft 45. The front end portion of the connecting member 66 is screwed into the base part 651 of the pin-gripping part 65.

The claws 653 extend frontward from the front end of the base part 651 to be accommodated in the front portion of the anvil 62. The claws 653 are arranged at equal intervals on an imaginary circle around the driving axis A1. When the pin-gripping part 65 is located at an initial position shown in FIG. 1, a front end portion 654 of the claws 653 project frontward from the front end of the bore 621. A thickness in the radial direction of the front end portion 654 is set to be slightly larger than that of the other portion of the claw 653. The rear end portion of the front end portion 654 is formed as a tapered part, of which an outer diameter gradually decreases toward the rear. With such a configuration, the gripping force of the claws 653 gripping the pin 81 increases as the pin-gripping part 65 moves rearward from the initial position and the front end portion 654 enters the bore 621 of the anvil 62 and thereby the claw 653 is pressed radially inward. The tapered part formed in the front end portion 654 of the pin-gripping part 65 and the tapered surface formed in the front end portion of the anvil 62 allow the front end portion 654 to enter the bore 621 smoothly.

As described above, the fastening tool 1 can also fasten workpieces via the tear-off type fastener by replacing the anvil 62 and the pin-gripping part 65. Although not described or shown in detail, an anvil and a pin-gripping part for the tear-off type fastener are different in shape from the anvil 62 and the pin-gripping part 65, but have substantially the same functions as the anvil 62 and the pin-gripping part 65.

As described above, in the fastening tool 1 of the present embodiment, the motor 21 and the ball-screw mechanism 4 are disposed in the tool body 10 such that the rotational axis A2 of the motor shaft 213 is parallel to the driving axis A1. Further, a portion of the handle 17 (the upper end portion) is located in the rear space of the motor body 211.

Accordingly, compared to an embodiment in which the motor 21 is arranged such that the rotational axis A2 and the driving axis A1 extend in directions crossing each other, the motor 21 and the ball-screw mechanism 4 can be disposed to be closer to each other. Further, the first intermediate shaft 32 and the second intermediate shaft 33 that transmit the power from the motor 21 to the ball-screw mechanism 4 are also parallel to the rotational axis A2 and the driving axis A1. With such a configuration, an energy loss can be suppressed, so that efficient power transmission from the motor 21 to the ball-screw mechanism 4 can be achieved. Further, the size of the entire driving mechanism 3 can be made compact.

Further, since the handle 17 is partially located in the rear space of the motor body 211, the user can grip the handle 17 at a position that is relatively close to the driving axis A1 (that is also relatively close to heavy components), so that operability of the fastening tool 1 can be improved. In particular, in the present embodiment, since the trigger 171 is located on the rotational axis A2 of the motor shaft 213, the hand of the user can be surely led to the portion of the handle 17 (the upper end portion) that is located in the rear space of the motor body 211. This configuration leads to improvement of the operability. Further, since the tool body 10 and the handle 17 are connected to form an annular part (a ring or a loop), the strength of the handle 17 can be increased and possible breakage of the handle 17 can be reduced, compared to an embodiment in which the handle 17 is connected to the tool body 10 in a cantilever manner.

The fastening process of the workpieces using the fastener 8 is now described.

Firstly, the user inputs the control condition for the motor 2 (for example, a target value of the driving current) as needed via the manipulation part 231. Further, the user temporarily fixes the fastener 8 to the workpieces W. Here, to "temporarily fix" means, as exemplarily shown in FIG. 1, to insert the shaft 811 of the pin 81 into the through holes formed in the workpieces W such that the head 815 of the fastener 8 is held in contact with one side of the workpieces W, and loosely engage the collar 85 with the shaft 811 from the other side of the workpieces W.

As shown in FIG. 1, in the initial state in which the trigger 177 is not yet pulled (depressed), the screw shaft 45 and the pin-gripping part 65 are located at their initial positions (frontmost positions). The user fits the distal end of the shaft 811 of the pin 81 into the space formed at the center of the front end portions 654 (the portions projecting frontward from the bore 621) of the claws 654. The gripping force of the claws 653 at this time is set such that the claws 653 loosely grip the shaft 811. When the user pulls the trigger 171 and thereby the switch 172 is turned ON, the controller 20 (control circuit) starts normal driving of the motor 21 in accordance with the set control condition. The torque that is increased through the planetary-gear speed reducer 31, the driving gear 321, and the driven gear 411 is transmitted to the nut 41.

Figure 13:
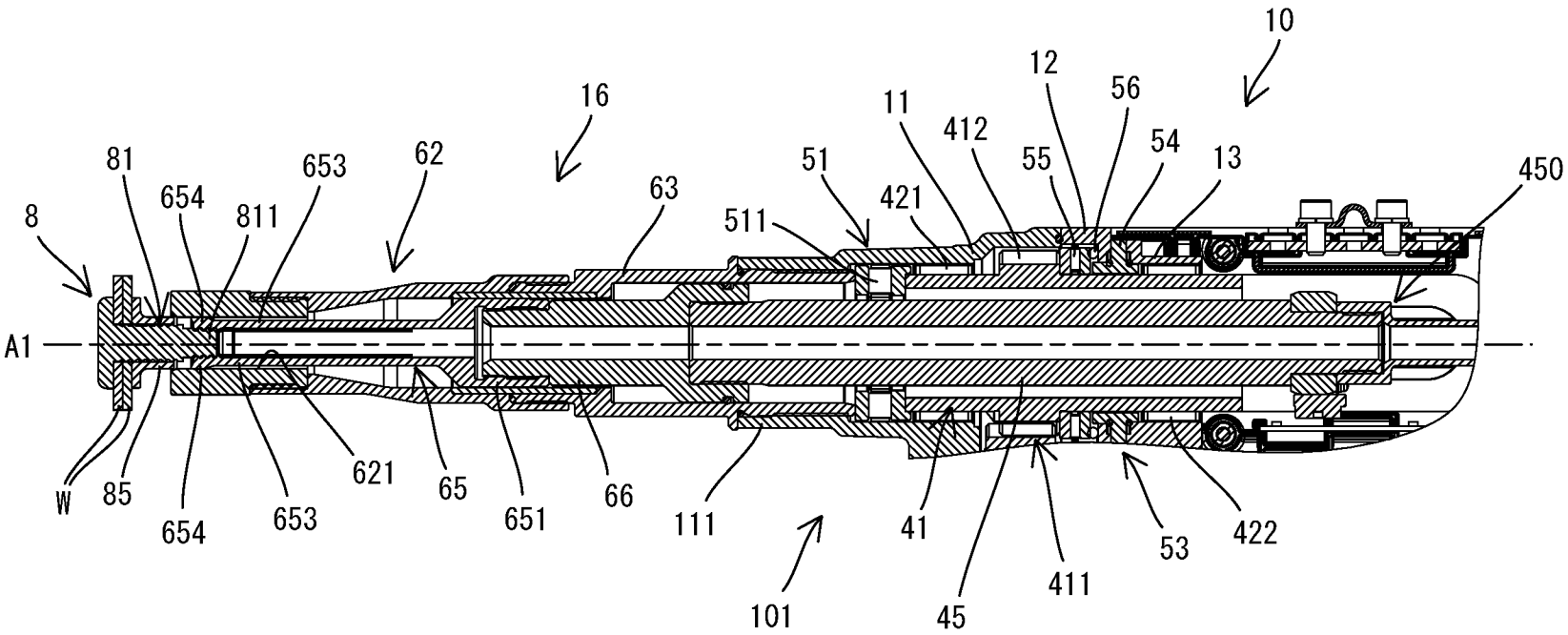
FIG. 13 is a view for explaining a fastening process.
Figure 14:
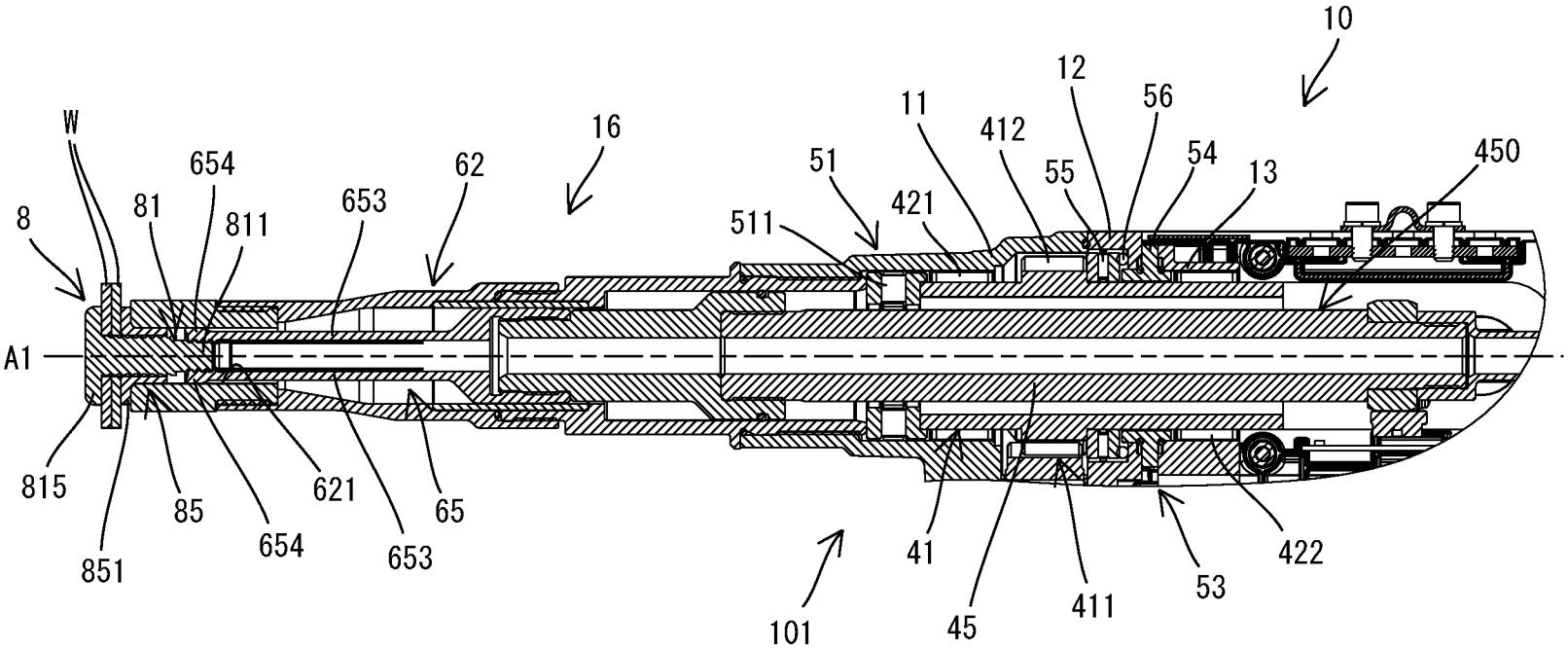
FIG. 14 is another view for explaining the fastening process.

As shown in FIG. 13, the screw shaft 45 moves rearward while the the nut 41 rotates, and the pin-gripping part 65 connected to the screw shaft 45 also moves rearward. The shaft 811 of the pin 81 is firmly gripped by the claws 653 and pulled rearward along the driving axis A1 while the front end portions 654 of the claws 653 enter the bore 621. As shown in FIG. 14, the collar 85 also enters the bore 621, and the flange 851 comes into contact with the front end surface of the anvil 62. The collar 85 is strongly pressed forward and radially inward and deformed by the anvil 62, and thereby the collar 85 is swaged onto the shaft 811. The workpieces W are thus firmly clamped between the collar 85 and the head 815 of the pin 81. In order to swage the collar 85 to the shaft 811, a large load is necessary. This load is applied to the nut 41 as the frontward reaction force via the pin-gripping part 65, the connecting member 66, and the screw shaft 45.

In the present embodiment, the front receiving part 51 (the thrust bearing 511) receives the frontward reaction force from the nut 41 while allowing the nut 41 to rotate and transmits the reaction force to the connecting sleeve 63. Meanwhile, the anvil 62 is pressed against the workpieces W via the collar 85 and receives the rearward reaction force. Thus, the anvil 62 and the connecting sleeve 63 integrally receive forces from both sides in the axial direction (the front-rear direction) that act to compress the anvil 62 and the connecting sleeve 63.

When the collar 85 is swaged onto the shaft 811 of the pin 81, fastening of the workpieces W is completed. The controller 20 (control circuit) stops the normal driving of the motor 2 when swaging is completed and stops the rearward movement of the screw shaft 45. Any known method can be employed for determining completion of the swaging (i.e., for controlling stopping of the rearward movement of the screw shaft 45). For example, the controller 20 may determine the completion of the swaging based on a driving state of the motor 21 (for example, the driving current of the motor 21, or the rotation speed of the motor 21). After the controller 20 stops the normal driving of the motor 21, the controller 20 starts reverse driving of the motor 21 and thereby moves the screw shaft 45 frontward, so that the screw shaft 45 and the pin-gripping part 65 are returned to their initial positions.

Figure 15:
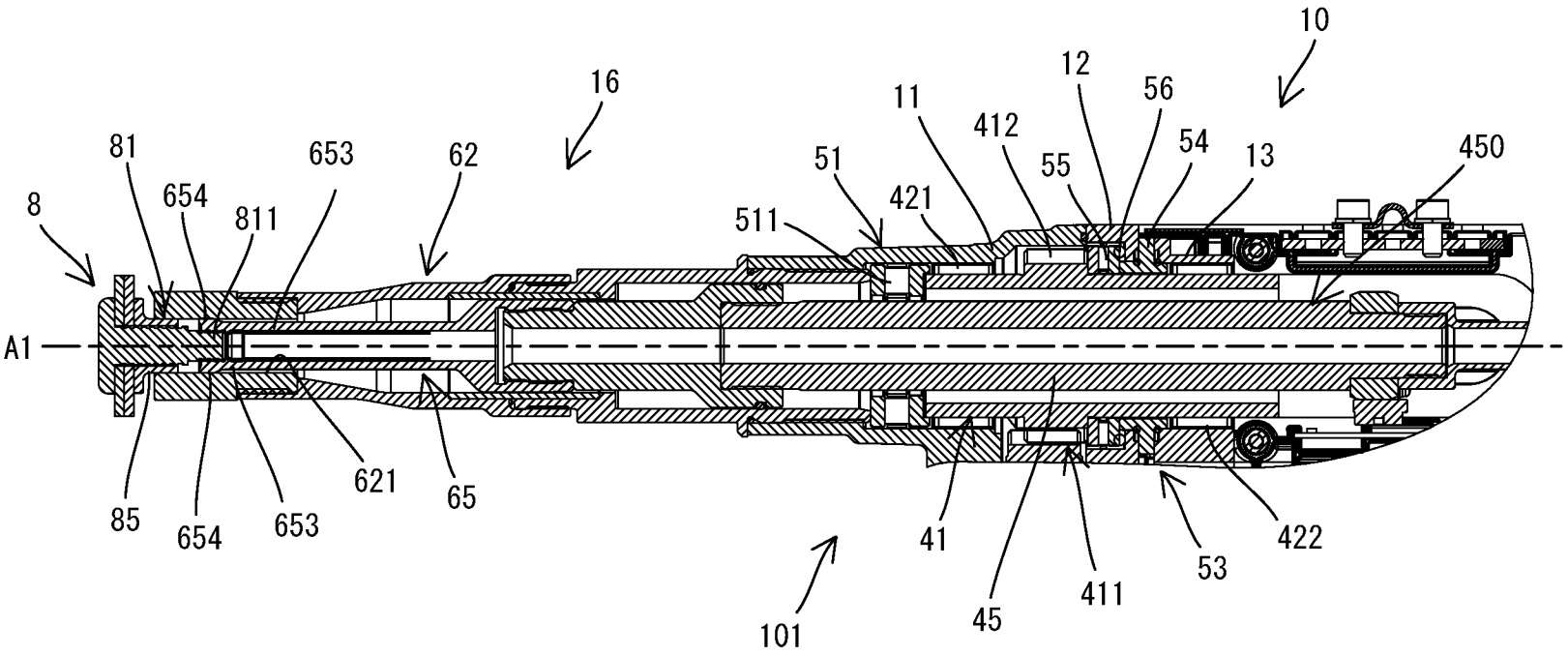
FIG. 15 is yet another view for explaining the fastening process.

As described above, since a large load is applied to the collar 85 when the collar 85 is swaged onto the pin 81, the collar 85 is firmly stuck to the front end portion of the bore 621 of the anvil 62 when the swaging is completed. Thus, in order to move the pin-gripping part 65 gripping the shaft 811 forward and to release the collar 85 from the anvil 62 as shown in FIG. 15, a relatively large load is required. This load is applied to the nut 41 as the rearward reaction force via the pin-gripping part 65, the connecting member 66, and the screw shaft 45.

In the present embodiment, the rear receiving part 53 disposed behind the driven gear 411 receives the rearward reaction force applied to the nut 41 via the driven gear 411. More specifically, as shown in FIG. 16, the rear end surface of the base portion of the driven gear 411 presses the thrust bearing 55 in response to the rearward reaction force. The thrust bearing 55 slightly moves rearward while compressing the elastic member 56 and then comes into contact (abutment) with the receiving member 54 (the front end surface of the body 541). The receiving member 54 thus receives the reaction force that is transmitted via the rear end surface of the driven gear 411 and the thrust bearing 55. During this time, the thrust bearing 55 allows smooth rotation of the nut 41.

As described above, the receiving member 54 is connected to the front housing 11 together with the center housing 12 and the rear housing 13 by the screws 19 directly screwed into the front housing 11. Thus, compared to an embodiment in which the receiving member 54 is connected to the center housing 12 or to the rear housing 13, instead of the front housing 11, when the receiving member 54 receives the reaction force, a possibility of loosening of the connection between the front housing 11, the center housing 12, and the rear housing 13 can be reduced.

Figure 17:
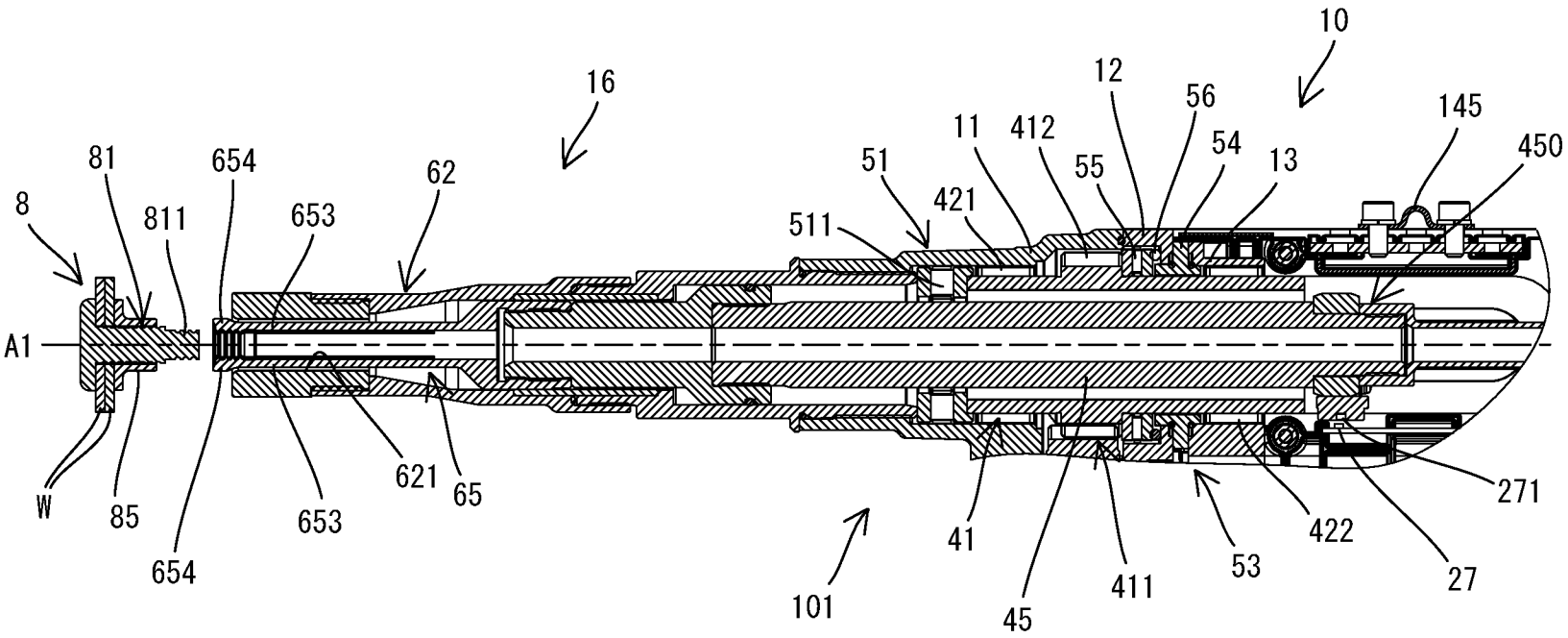
FIG. 17 is yet another view for explaining the fastening process.

In the process in which the screw shaft 45 and the pin-gripping part 65 return to their initial positions, the front end portions 654 of the claws 653 move frontward from the bore 621, and thereby the claws 653 move radially outward. As shown in FIG. 17, when the pin-gripping part 65 reaches the initial position, the fastener 8, of which the collar 85 has been swaged onto the pin 81, can be removed from the claws 653.

When the screw shaft 45 is placed back to the initial position, the controller 20 stops the reverse driving of the motor 21. Any known method can be employed for determining whether or not the screw shaft 45 is back to the initial position (i.e., for controlling stopping of the frontward movement of the screw shaft 45). Although not described in detail, the controller 20 may determine whether or not the screw shaft 45 is back to the initial position based on, for example, a detection result of a position sensor 27 that is configured to detect a position of the screw shaft 45 and then stop the reverse driving of the motor 21. As the position sensor 27, a hall sensor that is capable of detecting a magnet 271 that is fixed to the screw shaft 45 may be employed.

Although not shown in detail, the user can hang the fastening tool 1 using a wire, one end of which is fixed to a working space and the other end of which has a clasp that is engageable with the hook 145. Hanging the fastening tool 1 can eliminate the need for continuously holding the fastening tool 1 at the same posture. Further, the posture of the fastening tool 1 in actual use may vary, depending on the positions of the workpieces. The user can appropriately change the mount position of the hook 145, as described above, depending on the actual posture when the fastening tool 1 is used.

Further, the user can mount the auxiliary handle 91 (see FIG. 2) onto the mount part 111 as needed, as described above, so that the user can perform the fastening operation while firmly holding the handle 17 with one hand and holding the auxiliary handle 91 with the other hand. The handle 17 and the auxiliary handle 91 are respectively located rearward and frontward of the motor 21 and the driving mechanism 3, which are heavy components, and therefore the user can stably manipulate the fastening tool 1.

Correspondences between the features of the above-described embodiment and the claimed features are as follows. The features of the above-described embodiments are merely exemplary and do not limit the features of the present disclosure or the present invention. The fastening tool 1 is an example of the "fastening tool". The fastener 8, the pin 81, and the collar 85 are examples of the "fastener", the "pin", and the "tubular part", respectively. The motor 21, the motor body 211, the motor shaft 213, and the rotational axis A2 are examples of the "motor", the "motor body", the "motor shaft", and the "rotational axis of the motor shaft", respectively. The ball-screw mechanism 4 is an example of the "fastening mechanism". The driving axis A1 is an example of the "driving axis". The tool body 10 is an example of the "tool body". The handle 17 is an example of the "main handle".

The trigger 171 is an example of the "first manipulation member". The housing part 101 and the battery holding part 106 are examples of the "first portion" and the "second portion", respectively. The battery 93 is an example of the "battery". The extending part 103 is an example of the "third portion". The manipulation part 231 is an example of the "second manipulation member". The controller 20 is an example of the "controller". The ball-screw mechanism 4, the nut 41, and the screw shaft 45 are examples of the "ball-screw mechanism", the "nut", and the "shaft", respectively. The upper portion of the housing part 101 is an example of the "screw mechanism housing part". The lower portion of the housing part 101 is an example of the "motor housing part". The battery holder 15, the rail 155, and the terminal block 157 (terminal) are examples of the "battery holder", the "first engagement part", and the "first terminal", respectively. The engagement groove 931 of the battery 93 and the terminal 933 are examples of the "second engagement part" and the "second terminal", respectively. The elastic member 150 is an example of the "elastic member". The mount part 111 and the auxiliary handle 91 are examples of the "mount part" and the "auxiliary handle", respectively. The hook 145 is an example of the "engagement member".

The above-described embodiment is merely an exemplary embodiment, and therefore the fastening tool according to the present disclosure is not limited to the fastening tool 1. For example, the following modifications may be made. Further, one or more of these modifications may be employed in combination with any one of the fastening tool 1 described in the embodiment and the claimed features.

For example, not only the non-tear-off type fastener but also the tear-off type fastener of the multi-piece swage type fasteners can be used with the fastening tool 1, by replacing the anvil 62 and the pin-gripping part 65 as described above. Further, a known fastener that is called a blind rivet (or simply called a rivet) may also be used with the fastening tool 1 by replacing the anvil 62 and the pin-gripping part 65 with appropriate ones. The blind rivet is formed by a pin and a tubular part (also referred to as a sleeve or a rivet body) formed integrally with each other. Similar to the tear-off type multi-piece swage type fastener, a pintail of the blind rivet is also torn off in the fastening process. Further, the fastening tool 1 may be a tool dedicated to any one of the non-tear-off type multi-piece swage type fastener, the tear-off type multi-piece swage type fastener, and the blind rivet.

The shape of the tool body 10, the components and the connecting structure thereof may be modified as needed. For example, the extending part 103 may extend in a direction that is generally orthogonal to the driving axis A1. Further, for example, the center housing 12 and the rear housing 13 may be formed as a single (integral, non-separable) housing member. For example, the outer housing 14 may be formed by a plurality of housing members (for example, a box-like member and a tubular member) that are separately formed and connected together using fixing members (for example, screws), instead of the left and right halves. Similarly, the handle 17 may be formed separately from the tool body 10 and connected to the tool body 10 using fixing members (for example, screws).

The shape and the size of the hook 145 mounted to the tool body 10, and the structure and the arranged position of the plate 143 for mounting the hook 145 may be modified as needed. For example, the hook 145 may be fixed to a side wall of the tool body 10, instead of the upper wall 141 of the tool body 10. The hook 145 may be directly screwed to the tool body 10, instead of being mounted to the tool body 10 using the screws 147 that are separately provided. Further, the mount positions of the hook 145 (for example, the number of the threaded holes 144) may also be modified as needed. Also, the hook 145 may be omitted.

The structures and the arrangement of the mechanisms disposed within the tool body 10 may be modified as needed, for example, as follows.

For example, the motor 21 may be a brushed motor, an AC motor, or an outer rotor motor, in which a rotor is located radially outward of a stator, as long as the rotational axis A2 extends parallel to the driving axis A1.

Instead of the ball-screw mechanism 4, a feed-screw mechanism, which includes a nut and a screw shaft directly engaged with the nut, may be employed in the driving mechanism 4. The type and the arrangement of the bearings 421 and 422 that support the nut 41, and the components and the arrangement of each of the front receiving part 51 and the rear receiving part 53 are not limited to those described in the above embodiment. In the tool dedicated to the tear-off type multi-piece swage type fastener or the blind rivet, the rearward reaction force applied to the nut 41 when the screw shaft 45 is moved frontward is relatively small. Thus, the rear receiving part 53 may be omitted.

The mechanisms that transmit the power from the motor 21 to the ball-screw mechanism 4 is not limited to those described in the above embodiment. For example, the number of the planetary gear mechanisms included in the planetary-gear speed reducer 31 may be other than three. Instead of the planetary-gear speed reducer 31, a gear speed reducer including a gear train other than planetary gear mechanisms may be disposed between the motor 21 and the ball-screw mechanism 4. The idle gear 331 disposed between the driving gear 321 of the first intermediate shaft 32 and the driven gear 411 of the nut 41 may be omitted, and the driving gear 321 and the driven gear 411 may directly mesh with each other.

The battery holder 15 may be held at a side of the front wall 104 (front side) of the extending part 103, instead of being held by the battery holding part 106. Further, the battery holder 15 may be omitted, and the tool body 10 (for example, the battery holding part 106) may include a battery mount (e.g., the rails 155 and the terminal block 157) to which the battery 93 is attachable. In other words, the battery 93 may be directly attachable to the tool body 10 without using the battery holder 15. Further, the fastening tool 1 may be driven by electric power supplied from an external AC power source, instead of the battery 93.

The controller 20 may be disposed in the housing part 101 or in the battery holding part 106, instead of the extending part 103. Further, in an embodiment in which the extending part 103 is generally orthogonal to the driving axis A1, the controller 20 may be disposed in the extending part 103 such that its longitudinal direction is oblique to the driving axis A1. Also in such an embodiment, reasonable arrangement of the controller 20 in the extending part 103 can be achieved without increasing the size of the extending part 103. Similarly, the manipulation and display part 23 may be disposed on, for example, the upper wall of the battery holding part 106, instead of the rear wall 105 of the extending part 103. Further, the manipulation part 231 may include, instead of the push-button switches, one or more slide switches, a rotary dial, or the like. Alternatively, a touch screen, which is integrated with the display part 233, may be employed. The manipulation and display part 23 may be omitted.

The structure of the nose 16 may be modified as needed. For example, the shape of the anvil 62, connection between the anvil 62 and the tool body 10 via the connecting sleeve 63 may be modified. For example, the anvil 62 may be directly coupled to the tool body 10 (the mount part 111) without using the connecting sleeve 63. Similarly, the shape of the pin-gripping part 65 and connection between the pin-gripping part 65 and the screw shaft 45 via the connecting member 66 may be modified. For example, the pin-gripping part 65 may be directly coupled to the screw shaft 45 without using the connecting member 66. As long as the gripping force of the claws 653 changes in response to its movement in the front-rear direction relative to the anvil 62, the shape of the claws 653, and the number of the claws 653, for example, may be modified as needed.

Further, in view of the nature of the present disclosure, the above-described embodiments and the modifications thereto, the following Aspects 1 to 3 are provided. Any one of the Aspects 1 to 3 can be employed alone or in combination with any one of the fastening tool 1 of the above-described embodiment, the above-described modifications and the claimed features.

Aspect 1

The fastening tool further comprises an intermediate shaft that transmits the power of the motor to the fastening mechanism, and a rotational axis of the intermediate shaft extends parallel to the driving axis.

Each of the first intermediate shaft 32 and the second intermediate shaft 33 is an example of "the intermediate shaft" in the aspect.

Aspect 2

The mount part is provided around the front end portion of the first portion.

Aspect 3

The engagement member is a hook that is mounted to the tool body using at least one screw, and the tool body has a plurality of threaded holes with which the at least one screw is selectively engageable.

The hook 145 and the threaded hole 144 are examples of "the hook" and "the threaded hole" in this aspect, respectively.

DESCRIPTION OF THE REFERENCE NUMERALS

1: fastening tool, 10: tool body, 101: housing part, 103: extending part, 104: front wall, 105: rear wall, 106: battery holding part, 107: bottom wall, 108: projecting part, 109: flange part, 11: front housing, 111: mount part, 12: center housing, 121: rear wall, 13: rear housing, 131: guide member, 133: flange part, 14: outer housing, 141: upper wall, 143: plate, 144: screw hole, 145: hook, 146: through hole, 147: screw, 148: opening, 149: cap, 15: battery holder, 150: elastic member, 151: upper wall, 153: peripheral wall, 155: rail, 157: terminal block, 16: nose, 17: handle, 171: trigger, 172: switch, 19: screw, 20: controller, 21: motor, 211: motor body, 213: motor shaft, 23: manipulation and display part, 231: manipulation part, 233: display part, 27: position sensor, 271: magnet, 3: driving mechanism, 31: planetary-gear speed reducer, 32: first intermediate shaft, 321: driving gear, 33: second intermediate shaft, 331: idle gear, 4: ball-screw mechanism, 41: nut, 411: driven gear, 412: gear teeth, 421: bearing, 422: bearing, 45: screw shaft, 450: driving shaft, 451: extending shaft, 455: bearing, 51: front receiving part, 511: thrust bearing, 53: rear receiving part, 54: receiving member, 541: body, 543: connection part, 55: thrust bearing, 56: elastic member, 62: anvil, 621: bore, 63: connecting sleeve, 65: pin-gripping part, 651: base part, 653: claw, 654: front end portion, 66: connection member, 8: fastener, 81: pin, 811: shaft, 815: head, 85: collar, 851: flange, 91: auxiliary handle, 911: grip, 913: contact part, 915: belt, 916: bolt, 93: battery, 931: engagement groove, 933: terminal, 935: hook, A1: driving axis, A2: rotational axis, W: workpiece.

What is claimed is:

1. A fastening tool configured to fasten workpieces via a fastener including a pin and a tubular part, the fastening tool comprising:

a motor including a motor body and a motor shaft, the motor body including a stator and a rotor, the motor shaft extending from the rotor and configured to rotate integrally with the rotor;

a fastening mechanism configured to fasten the workpieces via the fastener by pulling the pin rearward relative to the tubular part along a driving axis, using power of the motor, the driving axis defining a front-rear direction of the fastening tool;

a tool body that houses the motor and the fastening mechanism; and an elongate main handle extending in a direction crossing the driving axis and connected to the tool body such that the main handle and the tool body together form an annular part, wherein:

a rotational axis of the motor shaft extends parallel to the driving axis, and a portion of the main handle is located in a rear space extending behind the motor body.

2. The fastening tool according to claim 1, further comprising:

a first manipulation member configured to be externally manipulated by a user for activation of the motor, wherein the first manipulation member is disposed on the main handle and located on the rotational axis of the motor shaft.

3. The fastening tool according to claim 2, wherein the tool body includes a first portion that houses the motor and the fastening mechanism; a second portion spaced apart from the first portion, extending parallel to the driving axis and configured to removably hold a battery;

a third portion spaced frontward from the main handle, extending in a direction crossing the driving axis and connecting the first portion and the second portion, two opposite ends of the main handle are connected to the first portion and the second portion of the tool body, respectively, and the first portion, the second portion, the third portion and the main handle together form the annular part.

4. The fastening tool according to claim 3, further comprising:

a second manipulation member configured to be externally manipulated by a user for inputting information, wherein the second manipulation member is disposed on the third portion and faces the main handle.

5. The fastening tool according to claim 4, further comprising:

a controller configured to control operation of the fastening tool, wherein the controller has a length, a width, and a thickness, among which the length is the largest, and the controller is oriented such that a length direction of the controller is oblique to the driving axis, the controller is disposed in the third portion such that a length direction of the controller is oblique to the driving axis.

6. The fastening tool according to claim 1, wherein:

the tool body includes a first portion that houses the motor and the fastening mechanism, and a second portion configured to removably hold a battery, and the first portion, the second portion, and the main handle at least partially form the annular part.

7. The fastening tool according to claim 6, wherein:

two opposite ends of the main handle are connected to the first portion and the second portion of the tool body, respectively, the tool body includes a third portion that is spaced frontward from the main handle and that extends in a direction crossing the driving axis, the third portion connects the first portion and the second portion, and the first portion, the second portion, the third portion and the main handle together form the annular part.

8. The fastening tool according to claim 7, further comprising:

a controller configured to control operation of the fastening tool, wherein the controller is disposed in the third portion.

9. The fastening tool according to claim 8, wherein:

the controller has a length, a width, and a thickness, among which the length is the largest, and the controller is oriented such that a length direction of the controller is oblique to the driving axis.

10. The fastening tool according to claim 7, wherein the second portion is spaced apart from the first portion and extends parallel to the driving axis, the third portion extends obliquely rearward relative to the driving axis from the first portion to the second portion.

11. The fastening tool according to claim 7, further comprising:

a second manipulation member configured to be externally manipulated by a user for inputting information, wherein the second manipulation member is disposed on the third portion and faces the main handle.

12. The fastening tool according to claim 6, wherein:

the fastening mechanism includes a ball-screw mechanism or a feed-screw mechanism comprising a hollow cylindrical nut and a shaft, the nut is supported in the tool body to be rotatable around the driving axis and configured to be rotationally driven around the driving axis by the power of the motor, the shaft is configured to move along the driving axis in response to rotational driving of the nut, the first portion includes a screw mechanism housing part that houses the ball-screw mechanism or the feed-screw mechanism, and a motor housing part that houses the motor, a rear end portion of the screw mechanism housing part projects further rearward relative to the motor housing part, and a longitudinal end of the main handle is connected to the rear end portion of the screw mechanism housing part.

13. The fastening tool according to claim 6, further comprising:

a battery holder including a first engagement part and a first terminal, the first engagement part being physically engageable with a second engagement part of the battery and the first terminal being electrically connectable to a second terminal of the battery, wherein the battery holder is held by the second portion via an elastic member.

14. The fastening tool according to claim 1, wherein the tool body has a mount part to which an auxiliary handle is mountable, the auxiliary handle being configured to be gripped by a user.

15. The fastening tool according to claim 1, further comprising:

an engagement member that is mounted to the tool body and that is engageable with a hanging member that is separate from the fastening tool, and the tool body is configured such that a mount position at which the engagement member is mounted to the tool body is changeable.

16. The fastening tool according to claim 1, wherein a longitudinal end of the main handle is located between the driving axis and the rotational axis of the motor in a direction that is orthogonal to the driving axis and the rotational axis.

* * * * *